US006769691B1

(12) United States Patent
Kim

(10) Patent No.: US 6,769,691 B1
(45) Date of Patent: Aug. 3, 2004

(54) APPARATUS FOR FINANCIAL INVESTMENT EDUCATION AND ENTERTAINMENT

(76) Inventor: Aaron Kim, 107 Hollins La., East Islip, NY (US) 11730-3006

( * ) Notice: Subject to any disclaimer, the term of this patent is extended or adjusted under 35 U.S.C. 154(b) by 0 days.

(21) Appl. No.: 10/287,217

(22) Filed: Nov. 4, 2002

(51) Int. Cl.[7] ..... A63F 3/00
(52) U.S. Cl. ..... 273/256; 273/278; 273/297
(58) Field of Search ..... 273/256, 278, 273/297; D21/347; 434/128, 129

(56) References Cited

U.S. PATENT DOCUMENTS 3,807,739 A * 4/1974 Henley et al. ..... 273/256
4,354,684 A 10/1982 McKinley
4,452,457 A 6/1984 Atieh et al.
4,535,994 A 8/1985 Cowan
4,856,788 A 8/1989 Fischel
4,871,177 A 10/1989 Mock
4,932,668 A * 6/1990 Stewart ..... 273/256
4,991,853 A 2/1991 Lott
5,071,135 A 12/1991 Campbell
5,262,815 A 11/1993 Aumiller
5,788,234 A 8/1998 Siofer
5,810,359 A * 9/1998 Wilkins et al. ..... 273/256
5,829,747 A 11/1998 Nebel
6,032,957 A 3/2000 Kiyosaki et al.
6,106,300 A 8/2000 Kiyosaki et al.
6,322,076 B1 11/2001 Fikki
6,446,970 B1 * 9/2002 Kyrollos ..... 273/278

* cited by examiner

*Primary Examiner*—Vishu K Mendiratta
(74) *Attorney, Agent, or Firm*—Michael I. Kroll

(57) ABSTRACT

The present invention 10 discloses a game to be played upon a board 12 wherein a plurality of spaces 14 are sequentially placed around the perimeter of the board. The spaces 14 comprise a plurality of property deed spaces with associated property deed cards 20, a plurality of stock certificate spaces with associated stock certificate cards 18, a plurality of option spaces with associated option cards 26, 28, a plurality of collect dividend spaces, a plurality of discounted housing unit spaces and a plurality of draw card spaces having associated therewith draw cards 30. An additional feature of the game may include a set of bond certificates 24 which can be used by each player to provide additional assets for the player to manage and which the player can use for various purposes.

1 Claim, 38 Drawing Sheets

COLLECT DIVIDENDS ON YOUR STOCK !!

| | |
|---|---|
| Penny Stock: | $0 Per Share |
| Terabyte Technologies: | $25,000 Per Share |
| Glamour Goldmines: | $50,000 Per Share |
| Biff's Burgers: | $100,000 Per Share |
| Marvelous Motors: | $200,000 Per Share |

32

30

PENNY STOCKS SKYROCKET !!

(You MAY SELL any PENNY STOCKS that you currently own to the bank at a price of $200,000 per share)

32

30

FIG.10

APPARATUS FOR FINANCIAL INVESTMENT EDUCATION AND ENTERTAINMENT

BACKGROUND OF THE INVENTION

Field of the Invention

The present invention relates generally to board games and, more specifically, to an educational asset management board game. The game is comprised of playing pieces, a board, money, stocks, property deeds, call and put option cards, housing units, instructional draw cards, bond repayment markers, and dice.

Each player picks a mating playing piece and property deed and is issued a predetermined amount of money with the objective of acquiring additional assets to purchase a predetermined number of housing units. The first player to acquire the predetermined number of housing units for their property is the winner.

The board has a plurality of marked spaces that a player advances on during their turn according to their roll of the dice. One of those spaces is the player' property that they receive a deed for at the start of game play and is their designated player piece starting point at the start of the game. The number of possible players is determined by the number of game board spaces designated as deeded properties. There is a game player piece for each of the game board deeded properties.

There is an additional element provided for by the present invention in the form of additional assets. The additional assets are bonds that are issued to each player at the start of game play in a predetermined amount. The use of bonds adds a level of complexity that is better suited for advanced play. Bonds can be presented to the bank for cash under specified redemption terms or they can be sold between players for terms that are specified by the participating parties. Bonds can be sold for a number of reasons aside from simply meeting debt obligations. They may be presented to the bank or other players for cash in order to purchase stocks, purchase other players bonds, purchase options, purchase housing units, negotiate"deals" with other players, or for any other situation.

The following game playing description describes the use of all the aforementioned components. So it should be noted that a beginner' version of the game can be produced without the use of the bond component.

At the start of game play every player selects or is assigned a playing piece and mating deeded property, as well as predetermined assets which are to be managed by the player to acquire additional assets to build a predetermined number of housing units on their property before any other player whereby they will be declared the winner.

Assets that are issued to players at the start of each game include a predetermined amount of money and optionally bonds which are used in the acquisition of stocks. The player' opportunity to buy stocks is contingent on the player rolling the dice and advancing the number of spaces equivalent to the total number of dimples displayed on the upper surface of the dice rolled by the player during their play period. Once a player lands on a board space having identifiable stock indicia they have the option of purchasing up to 10 shares of stock. An element of random cost is introduced by the fact that the player must announce the number of shares they wish to purchase before the actual cost per share is determined. Each stock board space has indicia indicating the highest and lowest price per share a stock can cost. The price is determined by the player rolling a die and paying a per share price equivalent to the total number of dimples displayed on the die and the per unit cost displayed for that number of dimples inscribed on the board space.

While the player may not have the funds necessary to acquire the announced number of stocks, the announcement is a contract and must be honored or the player is bankrupt and forfeits all assets to the bank. To meet the payment of the contract a player can present a bond to the bank and receive a predetermined prorated amount of cash based on the amount inscribed upon the face of the bond. The player is required to redeem the bond at face value within a specified number of game board revolutions of the player's token. To aid the players in keeping track of when a bond must be retrieved, the game provides bond repayment markers. A bond repayment marker is placed on the board at the current player position. When the bond issuing player lands on or passes their bond marker or the prescribed number of game board revolutions, they must retrieve their bond from the bank in exchange for cash at the full stated face value of the bond. Since there are a plurality of players the bond repayment markers are coded in such a manner has to be distinguishable from other players' bond repayment markers.

In addition to buying stocks related to the space that a player lands on a player can sell stocks acquired in previous turns. Again the player must announce their intent to divest themselves of stocks and the number of stocks they are going to sell before a sale price is determined. The board space indicium that is used to determine the price during a buy option is also used during a sell option. Therefore a player knows what the high and low price can be since there is a price displayed on the board space for each possible dimple, one to six, that can be displayed on a single die.

While there is an amount imprinted on the board space for all the possible outcomes for each dimple on a single die, the current board space also has indicia indicating how many dice are to be rolled with the outcome as to which die is used to determine the per unit cost as the die displaying the most dimples. The board space indicates whether one die or a plurality of dice are rolled with the die displaying the greater number of dimples determining the per unit value of the stock being bought or sold.

It should be noted that a player landing on a marked stock board space can elect to neither sell nor buy stock. It should also be noted that the terms of sale of stock between players are determined by the players and can take place at any time during the course of game play.

There is also another variable instrument that can affect the unit price of stock being bought or sold by a player. The player can be in possession of a call option card or a put option card. Both of which state on the card the number of dice dimples used to determine the unit cost. Therefore, the player does not have to roll one or more dice and knows the actual per unit value before announcing the buy or sell intention.

Besides the board spaces that are assigned to deeded properties and the buying and selling of stock, there are also a plurality of spaces that provide the player with an opportunity to buy put and call option cards, purchase housing units at a discounted price, collect dividends for owned stocks and spaces requiring the player to take a draw card and follow the directions imprinted thereon.

The draw cards introduce a high degree of uncertainty into the game. They can award or penalize the ownership of stocks and housing units or send a player to a deeded property or instruct the player to execute an instruction which can be of benefit or detriment to the player's assets.

The purpose of the game is to accumulate a predetermined number of housing units on your deeded property. A player does this by purchasing housing units from the bank at a substantial cost. Once a player places housing units on their property they can collect rent from other players who lands on the property. The amount of rent is stated on the deed based on the number of housing units that are on the property. The player landing on the property must satisfy the rent by paying the deed holder the amount stated on the deed in cash or other assets agreed upon between the deed holder and the rent paying player.

It should be noted that if a player owns housing units and they incur a debt requiring them to sell the housing units, the redeemable value is substantially less than the original purchase price.

Other than the collect dividend board spaces, random draw card, or transactions occurring between players the player receives predetermined amounts of money each time they pass or land on their property while advancing around the board through the course of play.

The game is designed to be entertaining by providing the player with the ability to manage assets in an effort to increase their worth which is determined by the number of housing units built upon their property.

The parallels to real financial situations are that individuals are confronted with financial situations without being able to determine whether an opportunity advances their net worth or endangers their net worth.

The game is designed to both entertain and educate players by introducing them to basic financial concepts and allowing them to manage their assets in various risk prone situations. It requires a bit of luck and common sense to reach one's goals.

DESCRIPTION OF THE PRIOR ART

There are other board games designed for entertaining and instructional purposes. Typical of these is U.S. Pat. No. 4,354,684 issued to McKinley on Oct. 19, 1982.

Another patent was issued to Atieh et al. on Jun. 5. 1984 as U.S. Pat. No. 4,452,457. Yet another U.S. Pat. No. 4,535,994 was issued to Cowan on Aug. 20, 1985 and still yet another was issued on Aug. 15, 1989 to Fischel as U.S. Pat. No. 4,856,788.

Another patent was issued to Mock on Oct. 3, 1989 as U.S. Pat, No. 4,871,177. Yet another U.S. Pat. No. 4,991,853 was issued to Lott on Feb. 12, 1991. Another was issued to Campbell on Dec. 10, 1991 as U.S. Pat. No. 5,071,135 and still yet another was issued on Aug. 4, 1998 to Siofer as U.S. Pat. No. 5,788,234.

Another patent was issued to Nebel on Nov. 3, 1998 as U.S. Pat. No. 5,829,747. Yet another U.S. Pat. No. 6,032,957 was issued to Kiyosaki et al. on Mar. 7, 2000. Another was issued to Kiyosaki et al. on Aug. 22, 2000 as U.S. Pat. No. 6,106,300 and still yet another was issued on U.S. Pat. No. 6,322,076 to Fikki as U.S. Pat. No. 6,322,076.

U.S. Pat. No. 4,354.684

Inventor: Paul F. McKinley

Issued: Oct. 19, 1982

A business strategy game is provided, such game including a game board having a playing area, said playing area having a plurality of playing token resting spaces, and a plurality of progress sections, each having a plurality of playing token resting spaces. Playing tokens for each player are positioned on the playing area and are movable thereon. The playing tokens are moved about the game playing area in turn in a directed fashion, as indicated by the random roll of the dice. Other playing tokens are advanced in coordinated manner as dictated by performance of instructions contained in indicia associated with the playing token resting spaces of the playing area, from beginning positions toward separate goals in separate progress sections. Two sets of instruction cards with different instructional indicia are utilized in playing. One or the other sets of cards is brought into play from time to time during the course of the game, pursuant to instruction indicia associated with the playing token resting spaces of the game board playing area. Random selection means, such as playing dice, are operated by each player in turn to determine their respective playing tokens circuitous movement about the playing token resting spaces of the gameboard playing area.

U.S. Pat. No. 4.452,457

Inventor: Sabah Atieh et al.

Issued: Jun. 5, 1984

A financial board game having a closed loop path divided into a plurality of discrete spaces interconnected to one another with each space providing an instruction for a player whose token lands thereon, a stock market pricing display including a plurality of stocks each of which has a plurality of indicia of stock values associated therewith, some of the discrete spaces having instructions indicating that a particular stock has gone up or down in value and other discrete spaces having instructions indicating that shares of a particular stock may be purchased. A marker movable in response to instructions from spaces of the closed loop path for collectively displaying the current indicia for each of the stocks. Control of a particular stock is obtained by a player accumulating a predetermined number of shares of the stock which represents control, thereby requiring the other players to pay a multiple of the current value of stock displayed by the stock market pricing display for each share of the controlled stock they purchase. Advantageously, an inner path interconnects with the closed loop path and includes interconnected discrete spaces some of which include instructions for forming a private corporation. A private corporation pricing display determines the selling price of each private corporation.

U.S. Pat. No. 4,535,994

Inventor: William P. Cowan

Issued: Aug. 20, 1985

This invention relates to board games, and more particularly to the apparatus for such a game which combines the elements of strategic skill, chance and knowledge of corporate finance and the business world to provide entertainment for two or more players. The game includes a track with industry segments further subdivided into corporation spaces. Ten corporate shares corresponding to each corporation space are utilized with a pair of dice. The dice are numbered from zero to five and direct the movement of the playing pieces as well as the maximum number of corporate shares a player may buy.

U.S. Pat. No. 4,856,788

Inventor: Mario Fischel

Issued: Aug. 15, 1989

A board game apparatus for simulating situations of economics and finance includes: (a) a game board defining a multiplicity of contiguous marked space playing positions defining a continuous closed track extending about the game board, each space playing position bearing indicia of instructions for play of the game; (b) a plurality of playing pieces representing each player; 8 die for determining how many space playing positions to move each playing piece; (d) simulated money of different denominations for use by the players of the game; (e) cards indicating ownership of assets for purchase and sale by players using the simulated money; and (f) cards on one face indicating an event having a potential economic effect on the game value of an asset held by a player, and, when turned over to the other face after the players have had an opportunity to act upon an expected economic effect of the event, revealing the actual game economic effect of the event. The indicia of instructions for play of the game on the game board includes one or more spaces instructing a player to consult the cards indicating an event having potential economic effect and includes one or more spaces permitting a player to buy and/or sell the cards indicating ownership of an asset. A method of playing the board game is also described.

U.S. Pat. No. 4,871,177

Inventor: Roger C. Mock

Issued: Oct. 3, 1989

A business board game in which players attempt to win the game by either purchasing a controlling share of stock of a particular industry or by purchasing a sufficient amount of stock in each industry so as to block any other player from gaining control of an industry; as opposed to merely amassing assets or forcing other players out of the game. The game further includes a variety of cards that affects the profits and losses of the various players owning stocks. Also, the game provides bankruptcy proceedings that enable a player to continue the game and still win.

U.S. Pat. No. 4,991,853

Inventor: Nathaniel E. Lott

Issued: Feb. 12, 1991

A board game wherein players, in turn, roll dice to determine which company is in play. That player then has the option to buy stock in that company. When a player owns enough stock to be declared chairman of the board, he or she takes possession of the chairman of the board card for that company. Now, in addition to earning dividends on stock held, the player holding the chairman of the board card also earns a quarterly salary and, as chairman of the board, is qualified to take the company to the next level of play thereby increasing the value of the stock, the quarterly dividends, the chairman of the board salary and the quarterly earnings of the company. Whenever another player owns more stock in a company than the current chairman of the board, that player takes possession of the chairman of the board card and is said to have taken over the company, thus, in the course of the game a company may change hands many times. Players encounter event cards that impact companies in play and personal cards that impact players holding chairman of the board cards. The player ending up with the most wealth at the end of the game is declared the winner.

U.S. Pat. No. 5,071,135

Inventor: Thomas J. Campbell

Issued: Dec. 10, 1991

A board game is disclosed which includes a game board having a peripheral playing path divided into several fields. The fields represent opportunities to buy or sell housing or stock, personal expenses to be paid, and salary to be received. The playing path is represented as one calendar year, and the fields are grouped into the four financial quarters of the year, wherein each side of the board represents a financial quarter. The game further includes game pieces representing housing and stock, tokens, dice for determining movement of the tokens along the path, and simulated currency. Also included are returns tables having indexed monetary amounts. The dice randomly selects a monetary amount and this amount is added to the value of an investment, adjusting its value. The game involves players buying and selling stocks and housing, paying personal expenses, rent and taxes, and receiving income. The object is to build the greatest financial worth.

U.S. Pat. No. 5,788,234

Inventor: Arthur Adam Siofer

Issued: Aug. 4, 1998

A business board game in which players attempt to win the game by transforming industries into cartels. Transformation of industries into cartels is by means of buying the majority of partnership stocks of all companies placed within specific industries. Controlling cartels enable players to sell essential products to their fellow players that own the partnership stocks in companies of other industries for a very high price to eventually cause bankruptcy. Such cartel product selling to other players is possible because the partnership stocks carry with them an unlimited liability. The game further includes cards that affect company book values per partnership stocks to further affect the market price of partnership stocks. Also, stock trading between players and the bank is involved where players try to make money by buying low and selling high, liquidate to cover expenses or just sell to escape the unlimited liability that comes along with owning partnership stocks. Players try to own as many partnership stocks as possible because they are the biggest source of income in the form of dividends. In addition, the game has a few companies that do not belong to any of the industries whose function is to provide services to the players for a fee.

U.S. Pat. No. 5,829,747

Inventor: Stephen E. Nebel

Issued: Nov. 3, 1998

A stock market big board game comprising a game board (14) having a continuous path around its perimeter (16) divided into consecutive spaces (18) bearing instructions for price fluctuations of individual companies and the market as a whole, market manipulation card purchase options, penalties, bonuses for stock diversification, move anywhere options, puts and calls, market trend changes, and stock price move options with each of the spaces (18) defining a playing position. A big board (20) is provided with a structure (22) for mounting the big board (20) vertically to the game board (14). A plurality of price marker pegs (24) for the big board (20), indicate on the big board (20) the activities of seven types of stocks purchased, such as stock prices and splits. A plurality of playing pieces (26) are provided, one for each of the game players. The playing pieces (26) being of a size to fit within the playing positions. Play money (28) of different denominations are for distribution of part thereof to each player. A random number generating facility (30) is for designating a number of spaces (18) on the game board (14) to be moved by each playing piece (26). A market trend indication piece (32) has a bull head (34) on one side and a bear head (36) on an opposite side. A deck of market manipulation cards (38), a deck of market fluctuation cards (40), a plurality of stock certificates (42) and a plurality of certificates of deposit (44) are also used in the game.

U.S. Pat. No. 6,032,957

Inventor: Robert T. Kiyosaki et al.

Issued: Mar. 7, 2000

A board game for teaching the principles of personal finance whereby significant wealth may be accumulated includes a playing board having a first, Rat Race, track and an entirely separate second, Fast Track. Each player begins the game on the Rat Race track and is provided with a Game Card to track his/her finances. The Game Card is configured as a combined Income/Balance Sheet, and basic accounting rules of personal finance are carefully followed in updating the Game Card while a player progresses along the Rat Race according to the roll of die. The Rat Race track includes spaces on which a player can land which presents unexpected financial obstacles, but the Rat Race also includes spaces which present financial opportunities. By prudently investing as opportunities arise, a player may obtain passive income in addition to a salary. Once a player's passive income exceeds his/her expenses, the player moves to the Fast Track for further play. On the Fast Track, a player enjoys the greatly improved life of one who has accumulated significant wealth. However, provision is made for unexpected problems in various Fast Track spaces along which a player moves. Thus, a player's ongoing financial condition while on the Fast Track is also carefully updated using basic accounting principles of personal finance. The game is played in accordance with formal rules which include provisions for declaring a winner.

U.S. Pat. No. 6,106,300

Inventor: Robert T. Kiyosaki et al.

Issued: Aug. 22, 2000

The present invention provides a particularly effective mechanism for teaching financial skills to players, and, in particular children, in the context of a game. Each player is initially ascribed a predetermined periodic earned income, (at least initially representing income from work activities of the player), periodic expenses and a predetermined amount of cash on hand. The object of such game is for a player to generate passive income greater than a predetermined percentage (e.g., 100%) of the player's expenses. The game comprises: indicia of a financial statement associated with each player; and indicia of a set of events and indicia of a set of game events for pseudo-random assignment to the players in turn. A mechanism for pseudo-randomly assigning the particular game event to the respective players is the also included. The game events potentially affect at least one of the passive income, expenses, assets and liabilities of the players, and include opportunities to generate passive income. The financial statement includes respective selectively revisable visual indicia of units of passive income, units of periodic expenses, assets and liabilities, and preferably units of periodic earned income, ascribed to the associated player. Each of the visual indicia has a respective predetermined associated visual aspect (e.g., shape and/or color) associated financial are being represented. The number of units of each of the visual indicia are selectively revisable to reflect the effects of game events.

U.S. Pat. No. 6,322,067

Inventor: Steve E. Fikki

Issued: Nov. 27, 2001

An investment board game and game method are disclosed. The board includes an endless path along which the players' game pieces are moved. The path includes a plurality of stock spaces, each representing a stock and a stock purchase price. Upon moving to one of the stock spaces, the player is permitted to purchase shares of stock for that space. If shares are purchased, the player must draw a stock value card which has the potential of changing the closing value of the stock. The stock value cards are preferably arranged into low, medium and high risk card sets, with the player being limited to selecting from one of the sets depending on the present value of the stock. A plurality of personal risk spaces are dispersed among the stock spaces along the path, and a player who moves to one of these spaces must draw a personal risk card that is likely to momentarily award or penalize the player. The board similarly includes a plurality of global risk spaces, and a player who moves to one of these spaces must draw a global risk card that has indicia representing a change in the purchase price and closing value for at least one stock. Spaced apart along the path are also a busted space and a confinement space, with the player who has landed on the busted space being required to move to the confinement space pay a penalty, and miss at least one turn.

While these investment games may be suitable for the purposes for which they were designed, they would not be as suitable for the purposes of the present invention, as hereinafter described.

SUMMARY OF THE PRESENT INVENTION

The present invention discloses a financial board game which is designed to be an educational asset management game. The board upon which the game is played is provided with a plurality of marked spaces about its perimeter upon which spaces the player advances during their turn according to their roll of the dice. One of the spaces is assigned or selected by the player at the start of the game to be the player's property and, likewise, the player is assigned a designed player piece matching the property. Additionally, at the start of the game, the player is given a predetermined amount of assets, e.g., money and/or bonds which is to be managed by the player to acquire additional assets with which to build a predetermined number of housing units; e.g., five, on their property. When a player achieves the building of the predetermined number of housing units on their property, they are declared the winner.

A primary object of the present invention is to provide an entertaining and educational game comprised of buying, selling and managing a financial portfolio.

Another object of the present invention is to provide a financial portfolio educational game comprised of stocks, bonds and options.

Yet another object of the present invention is to provide a financial portfolio educational game having a board having a plurality of spaces designated as financial transactions.

Still yet another object of the present invention is to provide a financial portfolio educational game where a player can buy and sell stocks.

Another object of the present invention is to provide a financial portfolio educational game where a player can place an option to buy and sell stocks in an atmosphere of uncertainty.

Yet another object of the present invention is to provide a financial portfolio educational game where a player learns the value and basic use of bond trading.

Still yet another object of the present invention is to provide a financial portfolio educational game where a player learns the value and basic use of call and put options.

Another object of the present invention is to provide a financial portfolio educational game where a player learns to negotiate with other portfolio players in asset management.

Yet another object of the present invention is to provide a financial portfolio educational game where a player learns to trade with other portfolio players.

Additional objects of the present invention will appear as the description proceeds.

The present invention overcomes the shortcomings of the prior art by providing a financial portfolio acquisition and management educational game comprised of buying, selling and leveraging a starting amount of assets in an effort to increase their net worth.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which:

FIG. 10 is another illustrative view of possible player draw cards instructions of the present invention.

LIST OF REFERENCE NUMERALS

Figure 1:
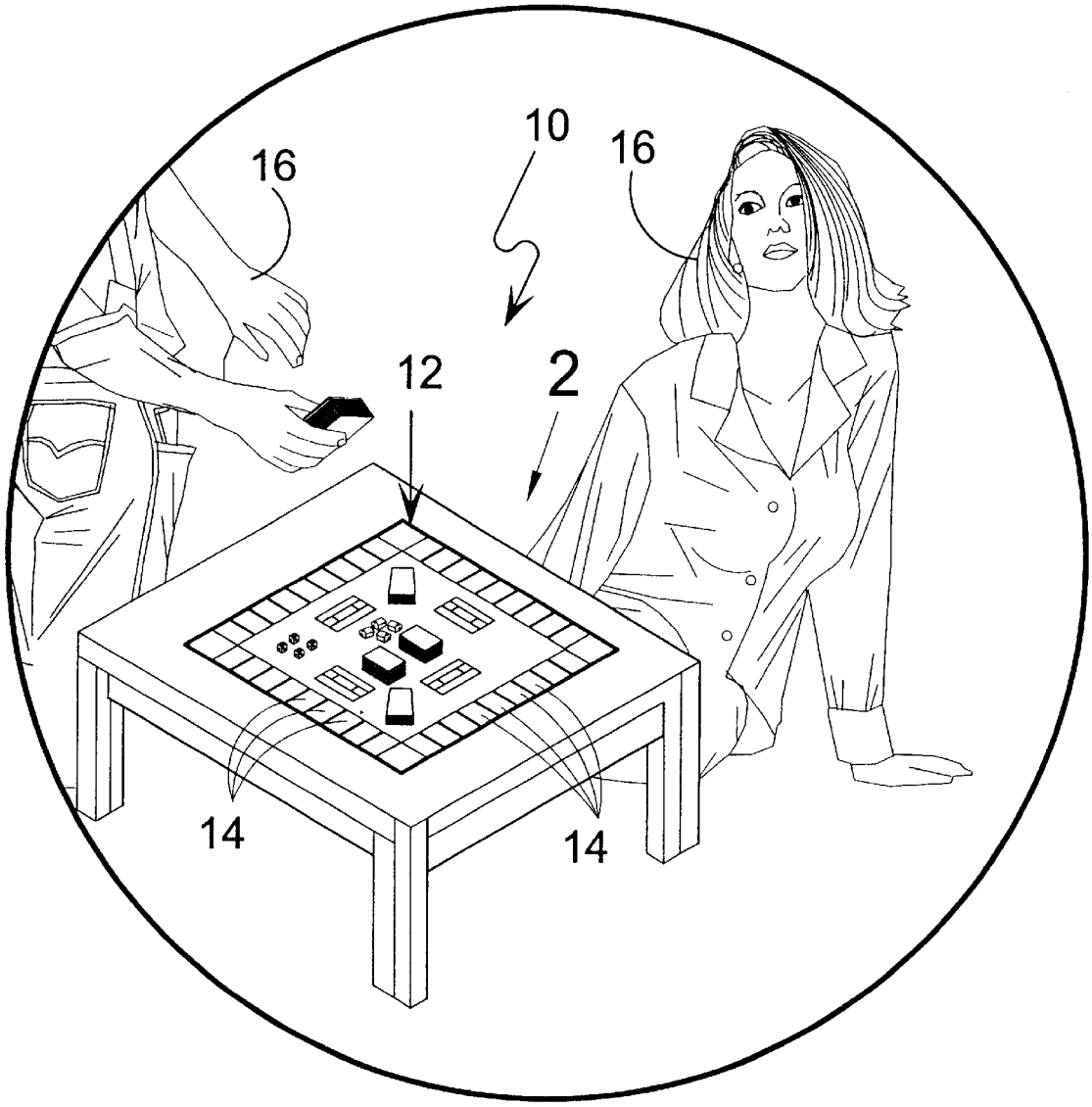
FIG. 1 is an illustrative view of the present invention in use.

With regard to reference numerals used, the following numbering is used throughout the drawings.

10 present invention
12 board
14 space
16 player
18 stock certificate card
20 property deed card
22 monetary bill
24 bond certificate
26 put option card
28 call option card
30 draw card
31 $ (dollar) sign
32 instructions
34 player piece
36 bond repayment markers
38 dice
40 housing unit

DESCRIPTION OF THE PREFERRED EMBODIMENT

The following discussion describes in detail one embodiment of the invention. This discussion should not be construed, however, as limiting the invention to those particular embodiments since practitioners skilled in the art will recognize numerous other embodiments as well. For a definition of the complete scope of the invention the reader is directed to the appended claims.

Turning to FIG. 1, shown therein is an illustrative view of the present invention 10 in use. The present invention 10, a financial asset management board game comprised of a board 12 which provides a playing surface divided into a plurality of board spaces 14 arranged about the perimeter of the board having indicia imprinted thereon whereby a number of players 16 can compete for a common goal of obtaining a predetermined number of housing units for their deeded property whereby they are declared the game winner. The board 12 may also have a plurality of spaces on the interior of the board which may be designated for various game related purposes but which are unnecessary to play the game.

Figure 2:
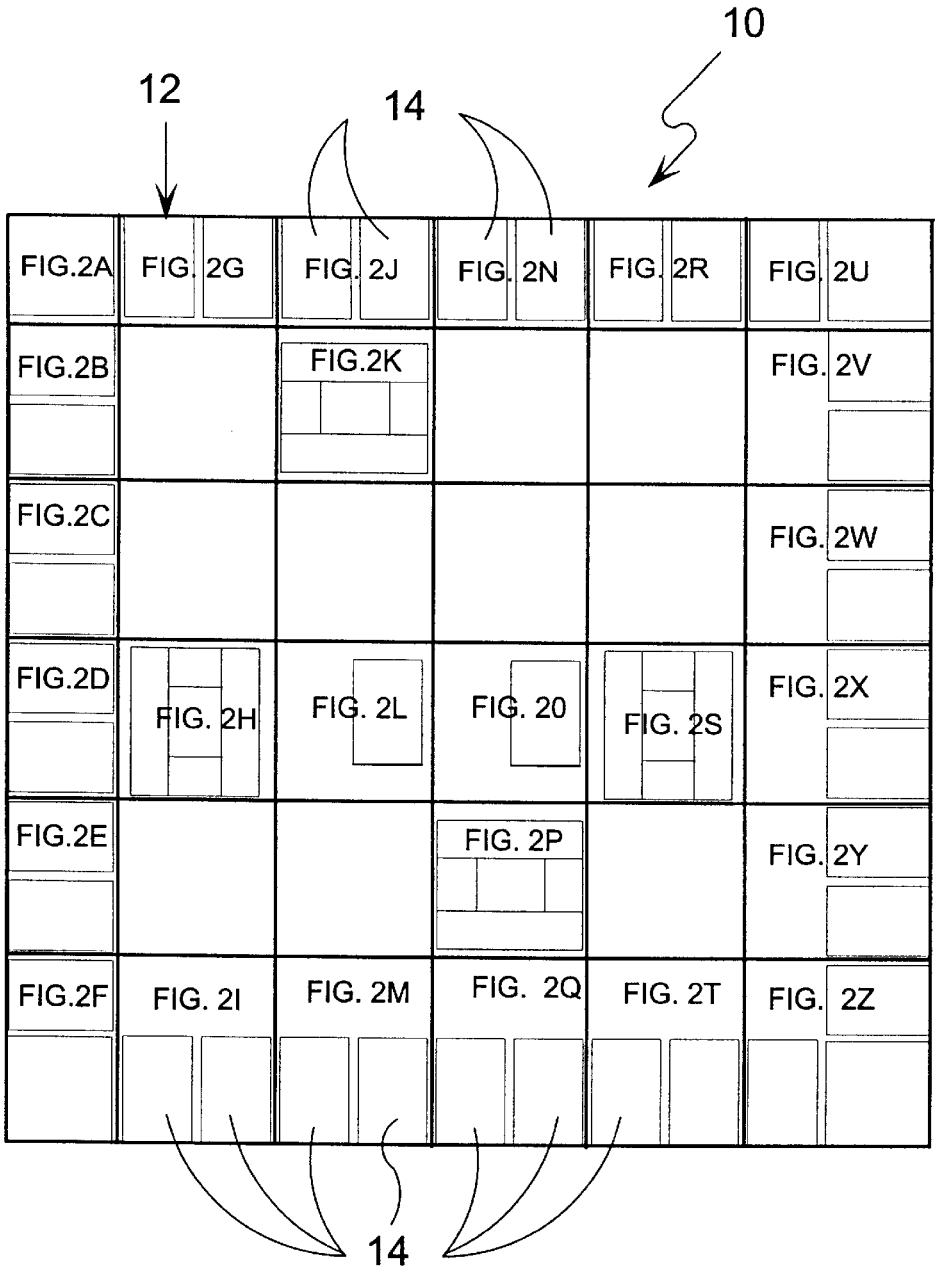
FIG. 2 is a block diagram depicting the location of the enlarged board sections shown in FIGS. 2A through 2Z.
Figure 2A:
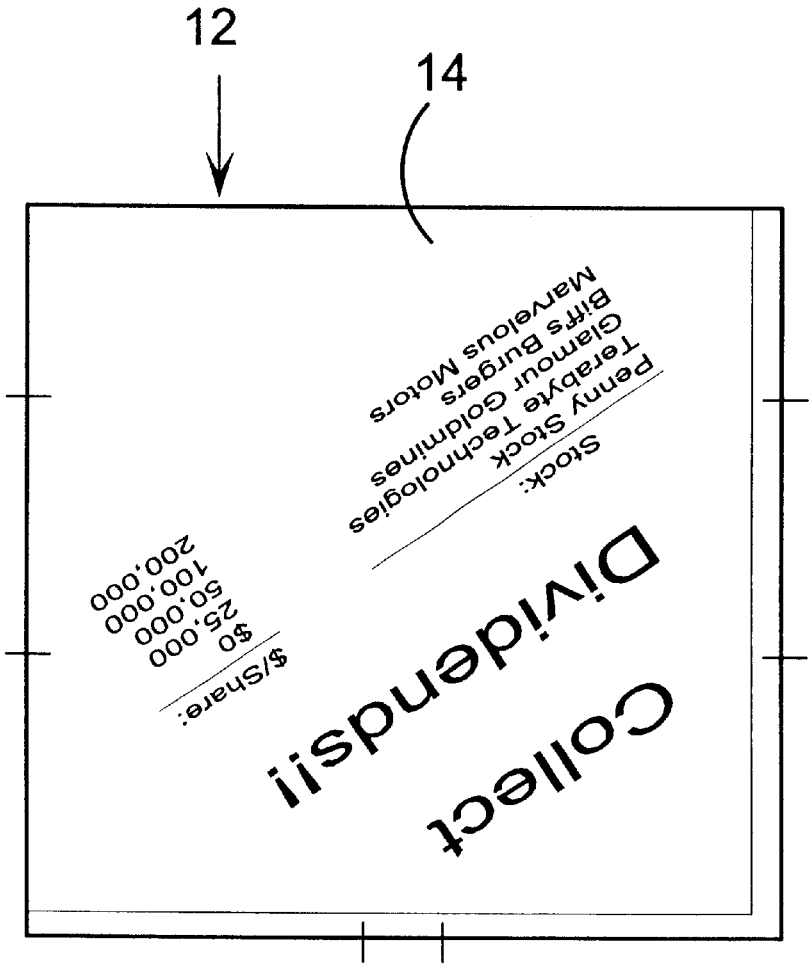
Figure 2B:
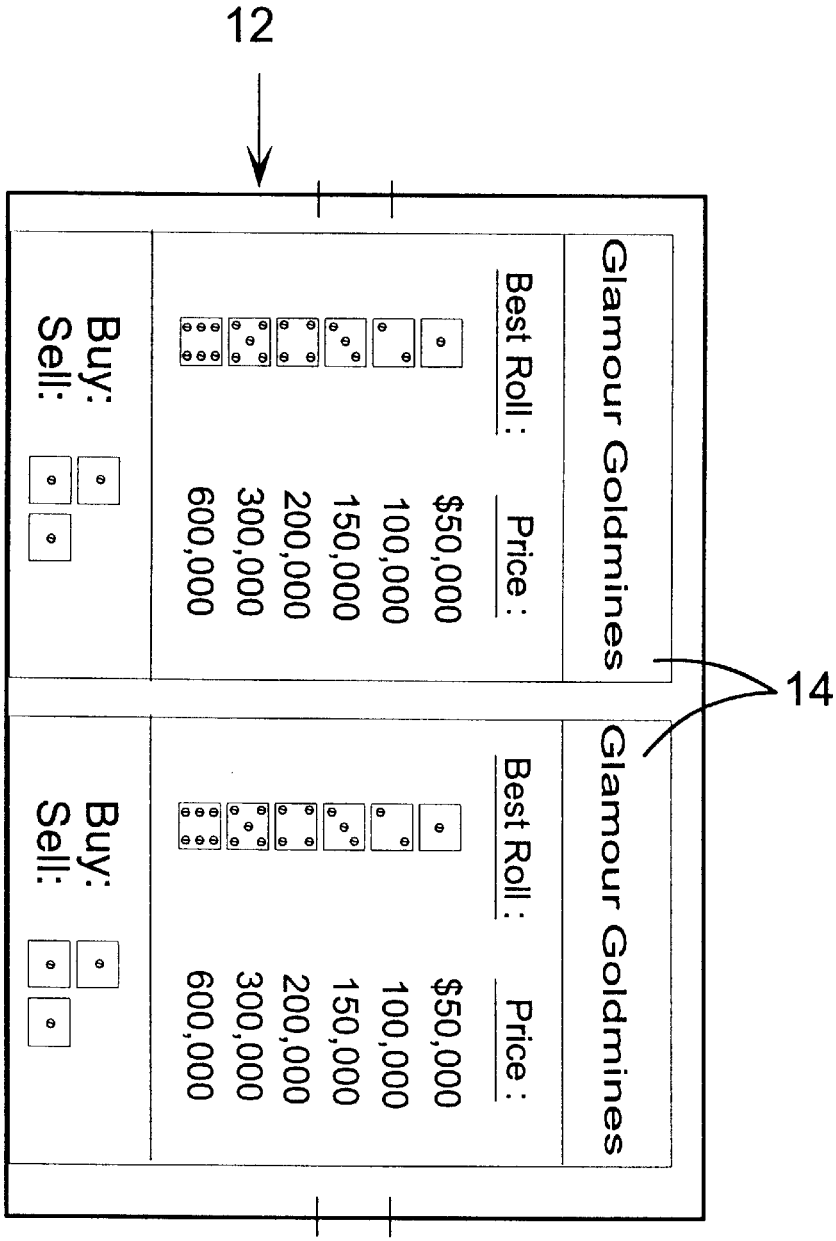
Figure 2C:
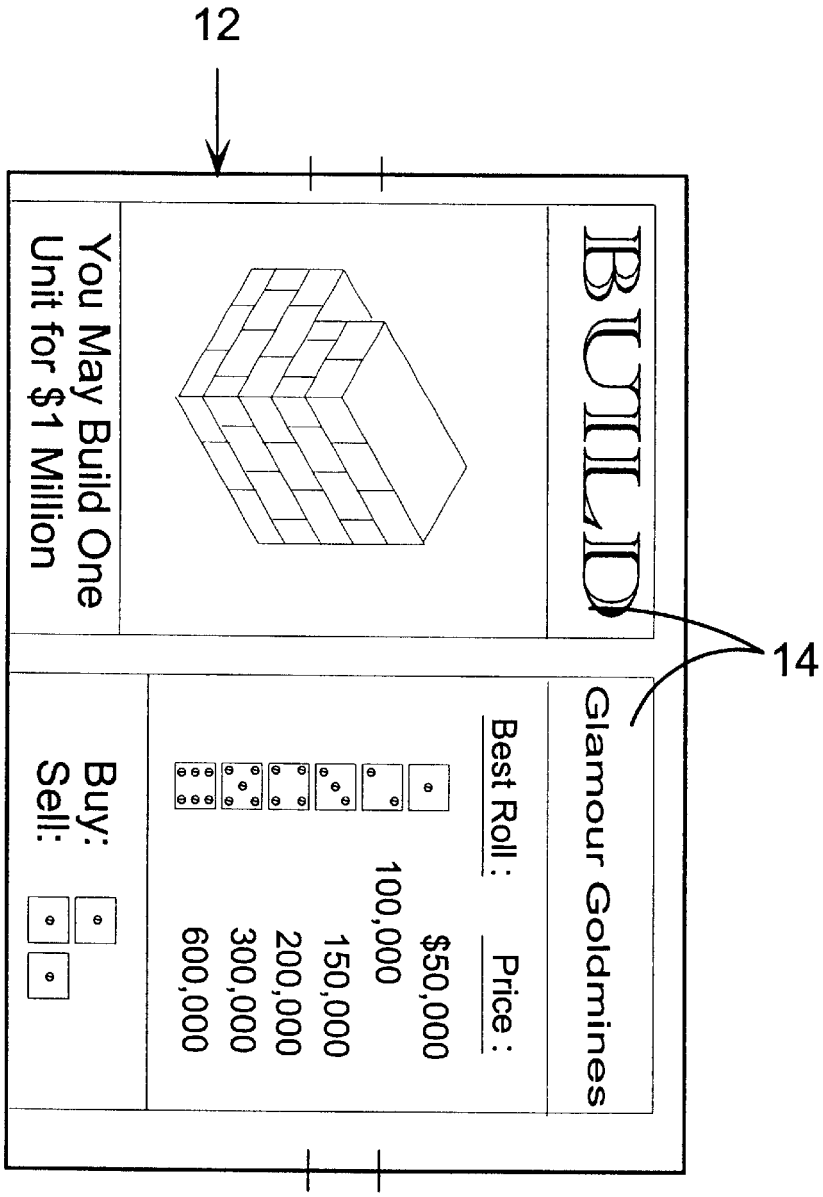
Figure 2D:
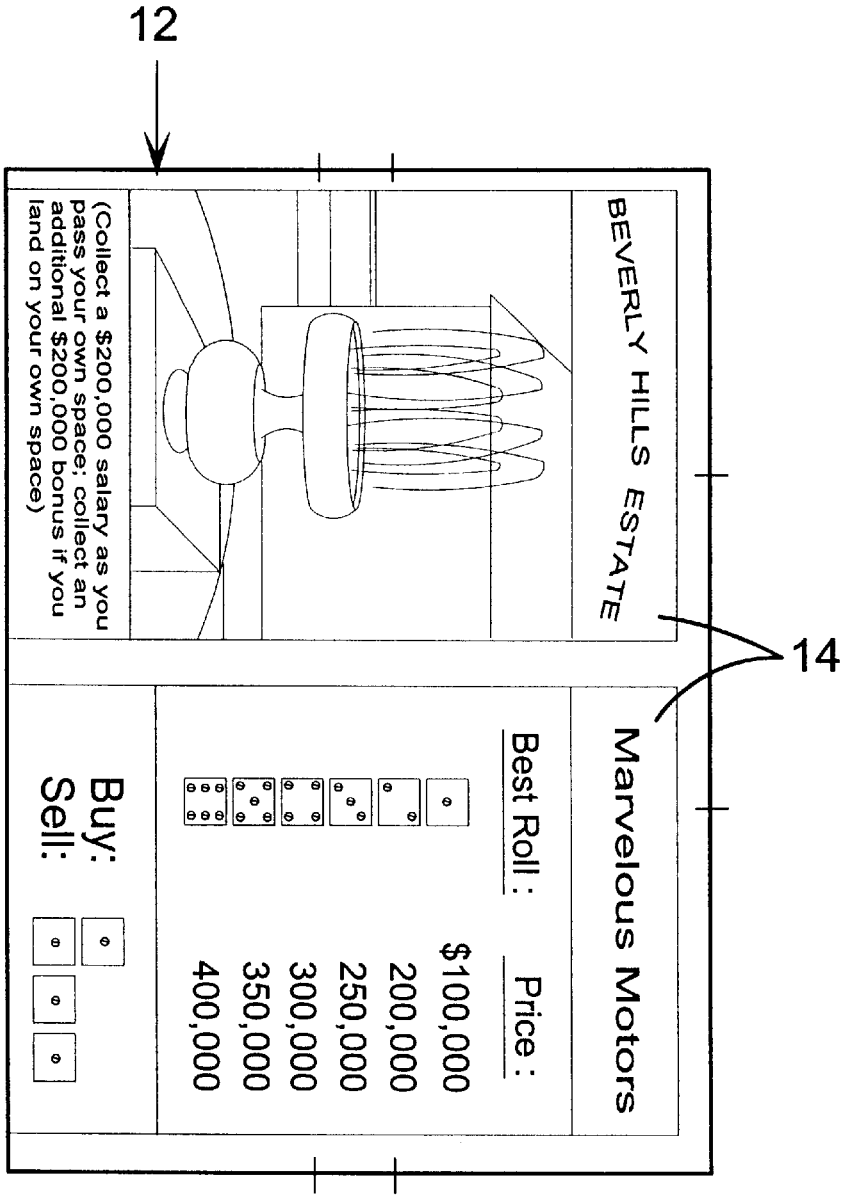
Figure 2E:
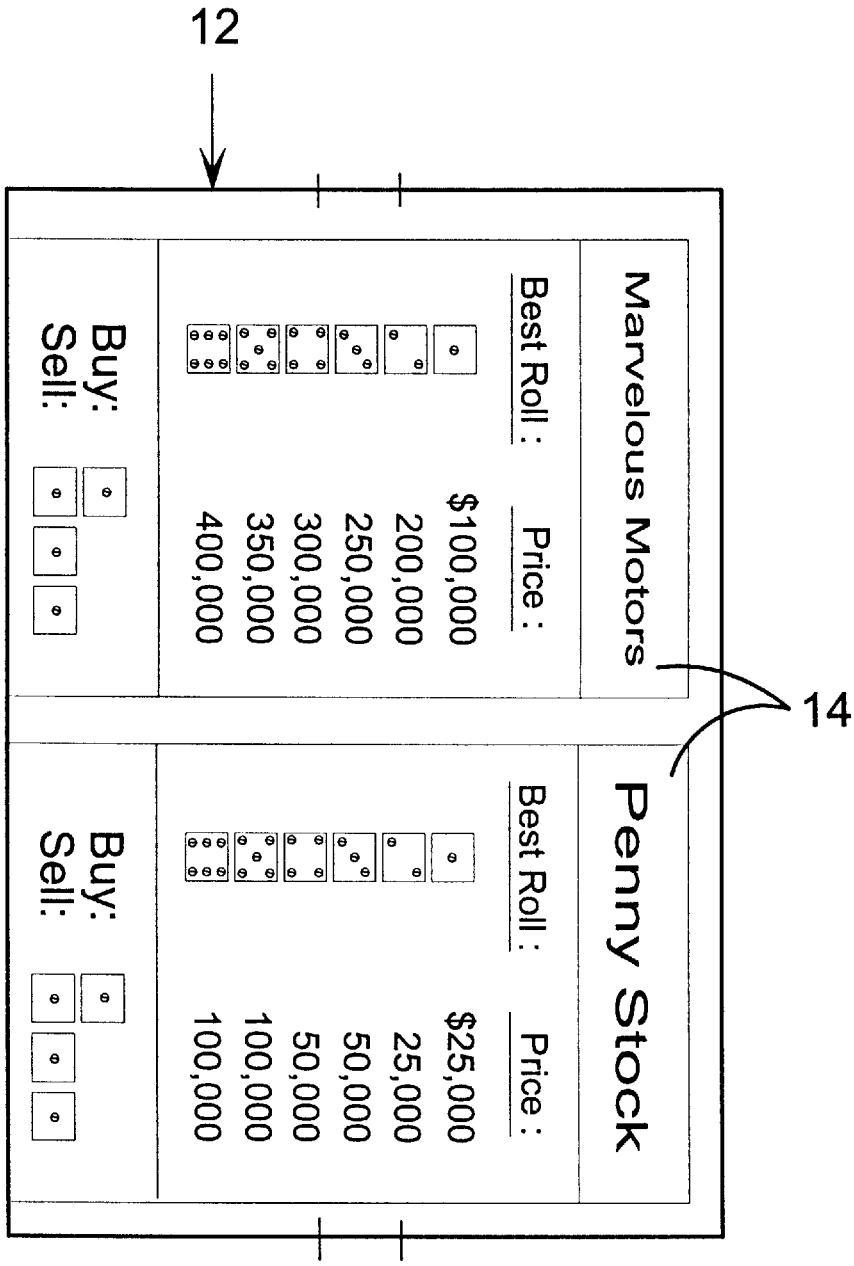
Figure 2F:
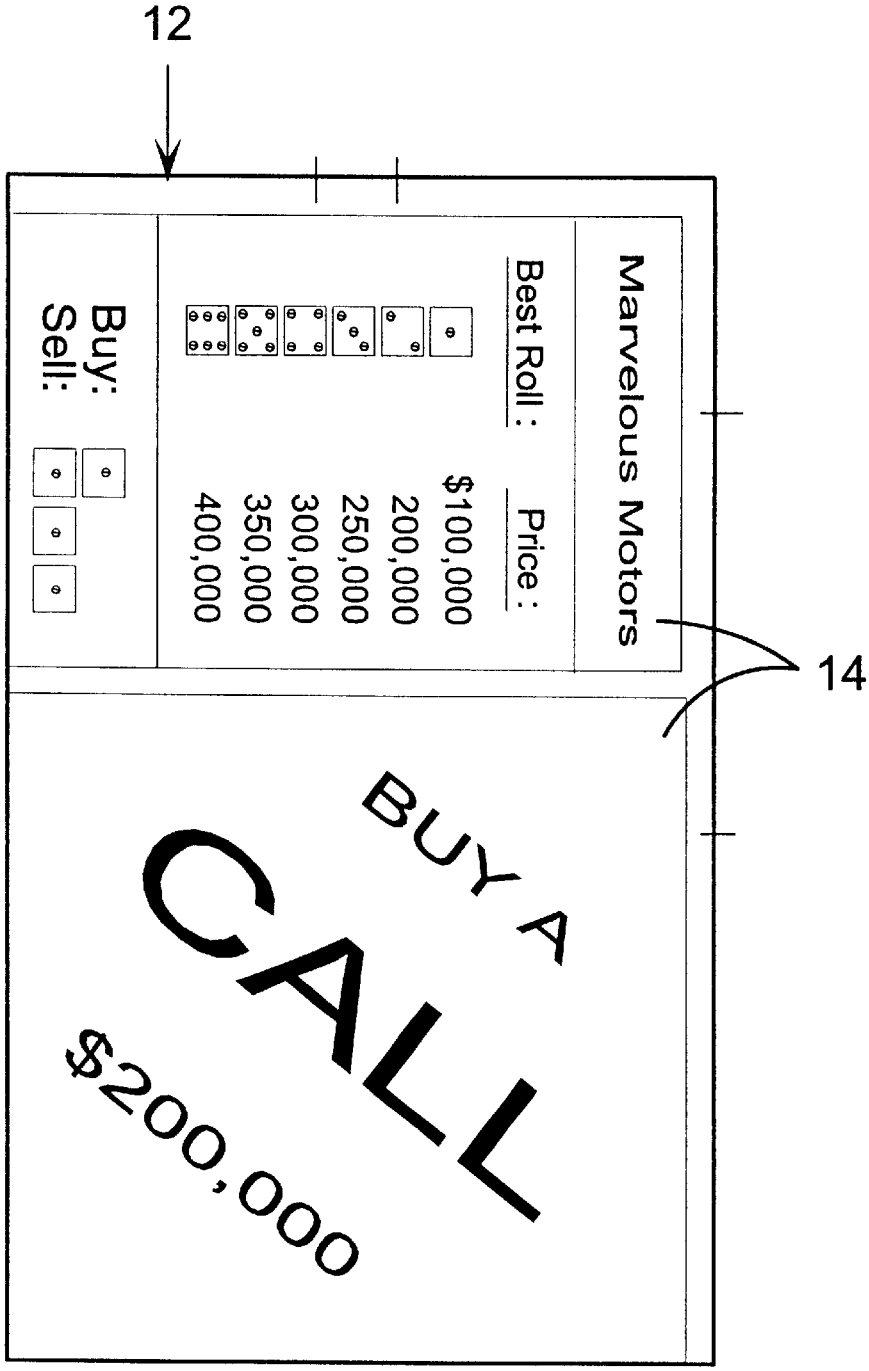
Figure 2G:
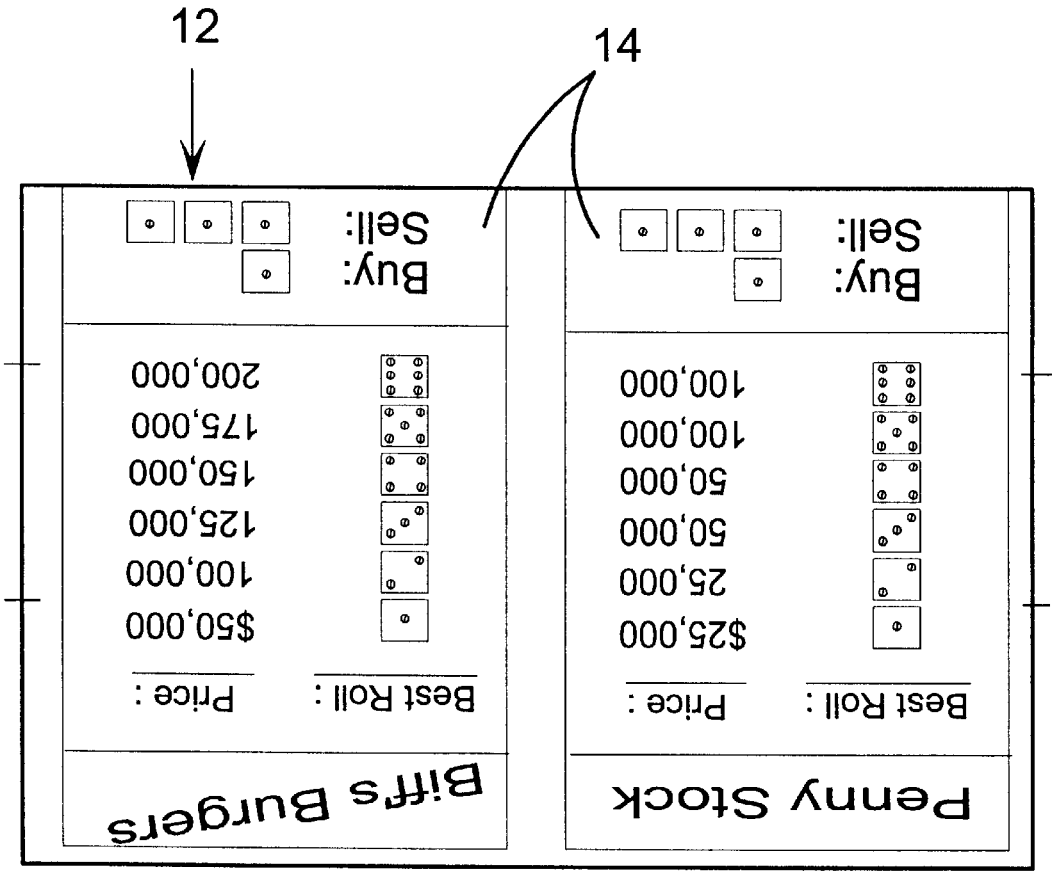
Figure 2H:
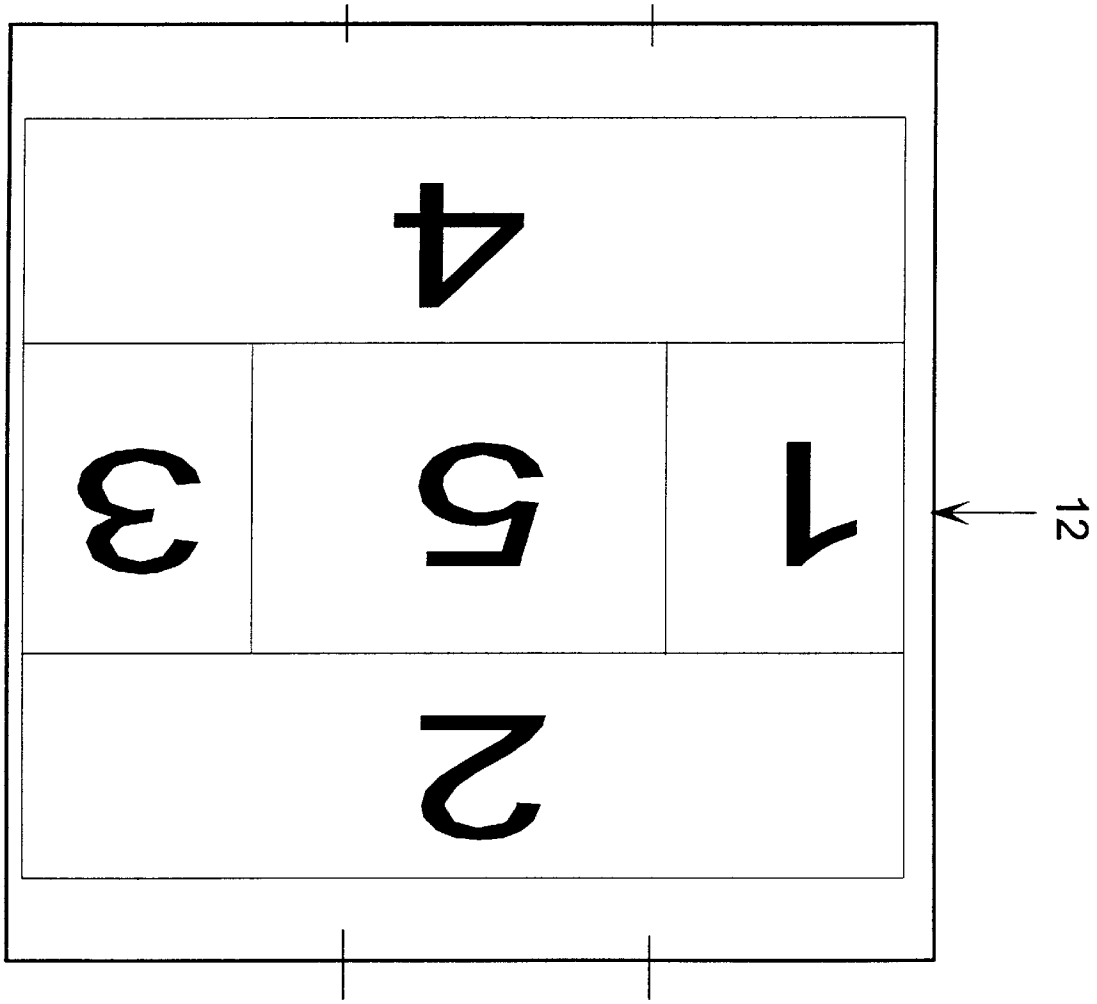
Figure 21:
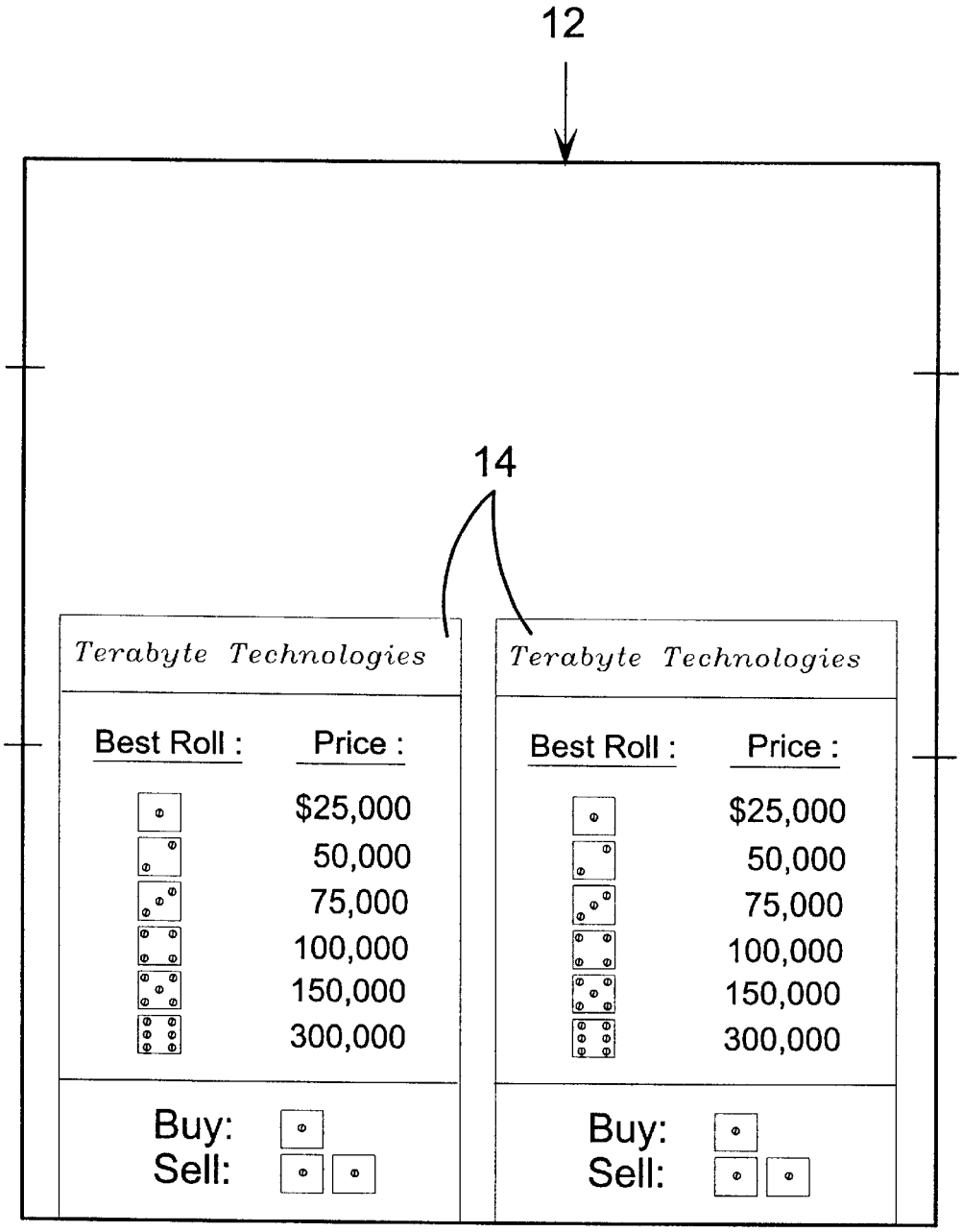
Figure 2J:
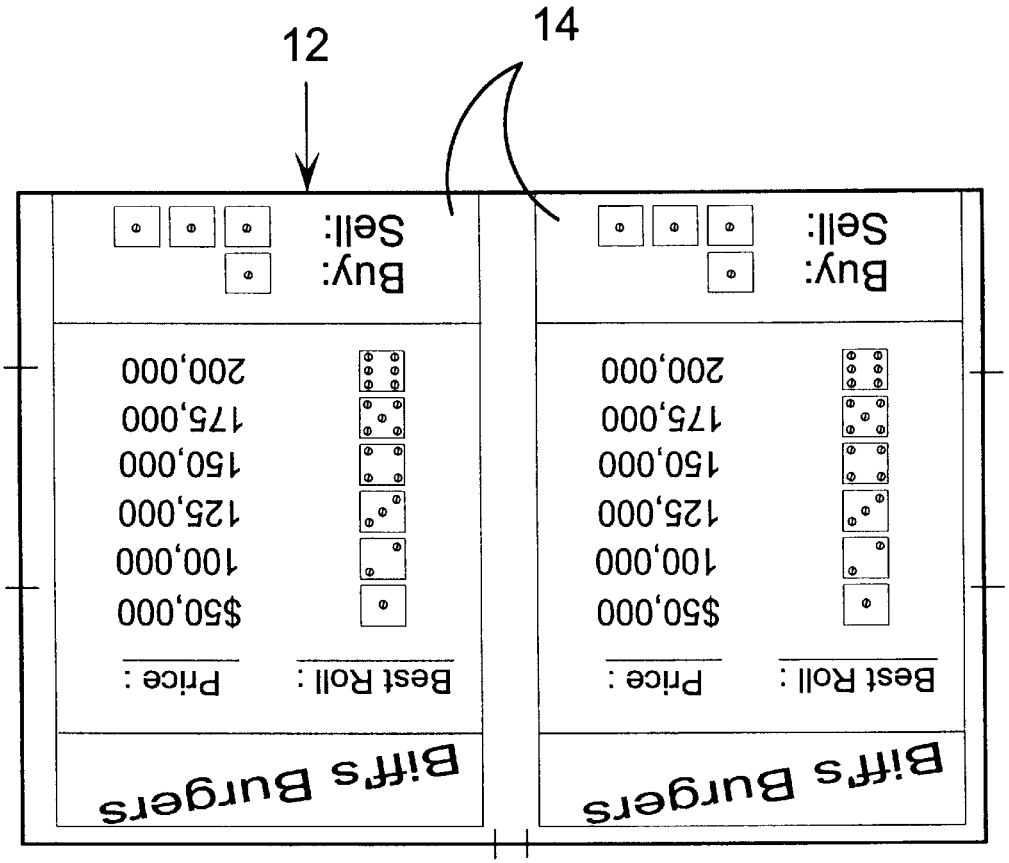
Figure 2K:
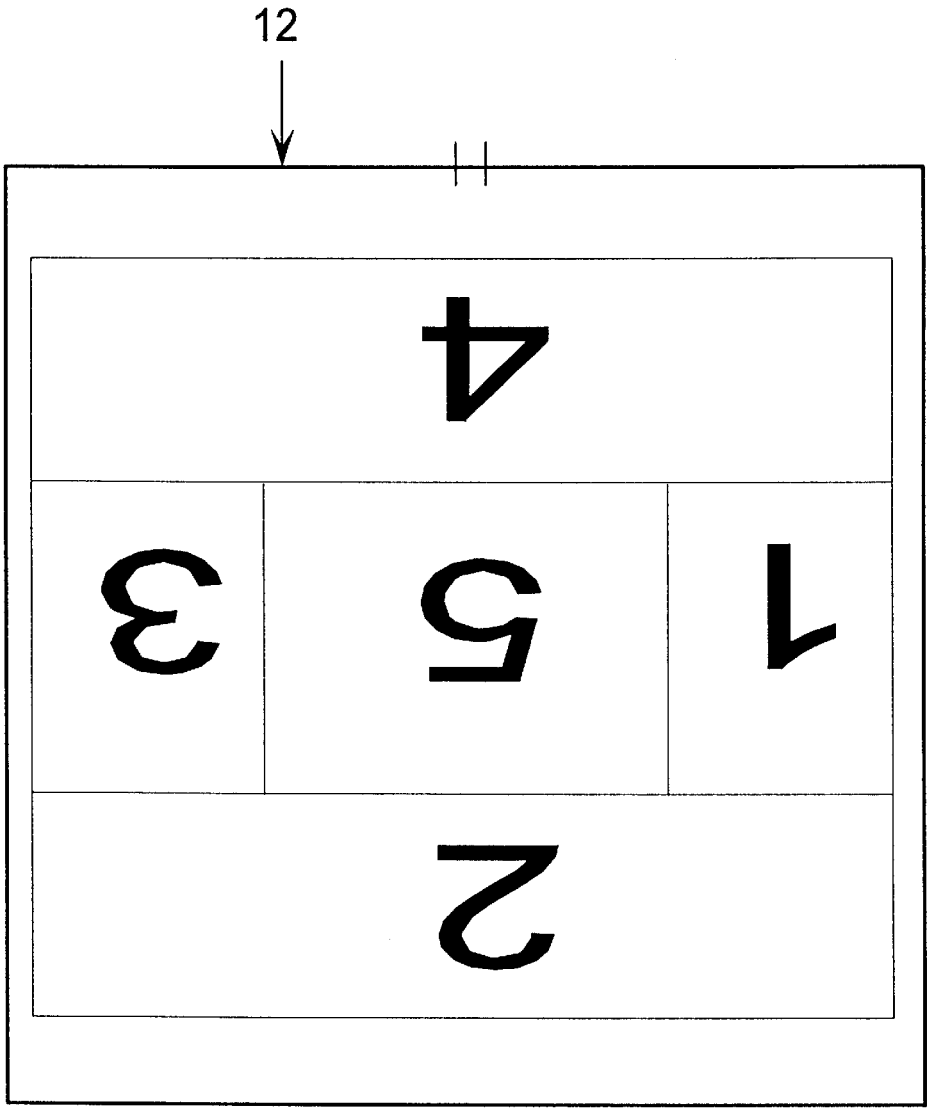
Figure 2L:
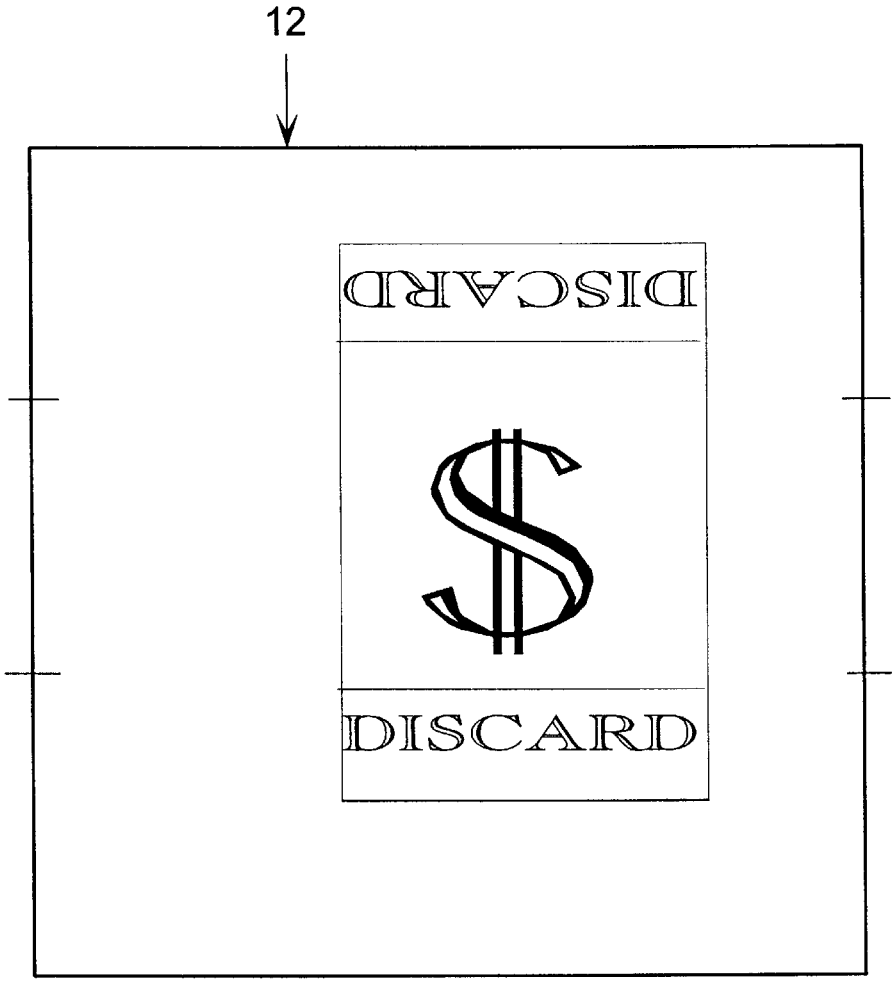
Figure 2M:
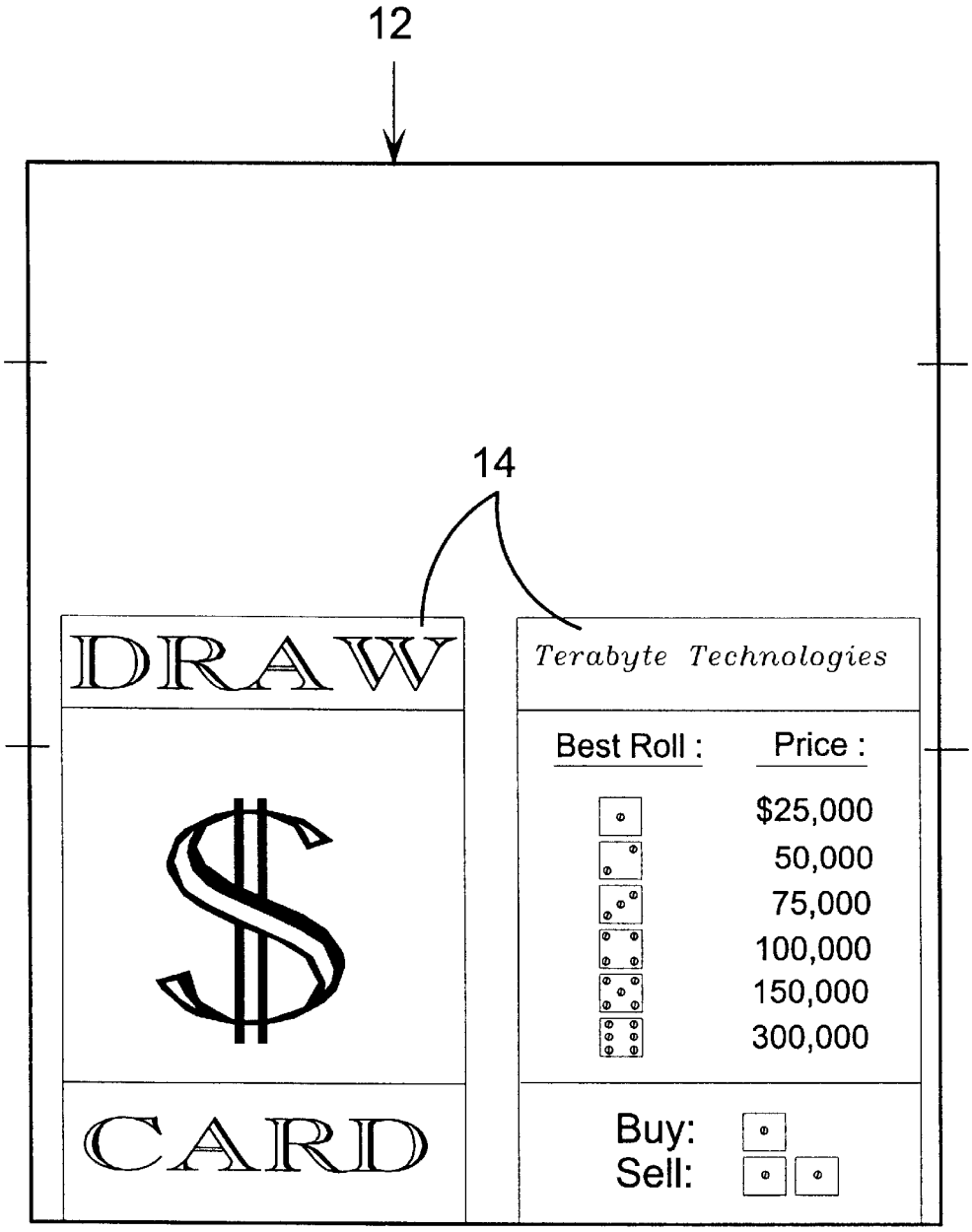
Figure 2N:
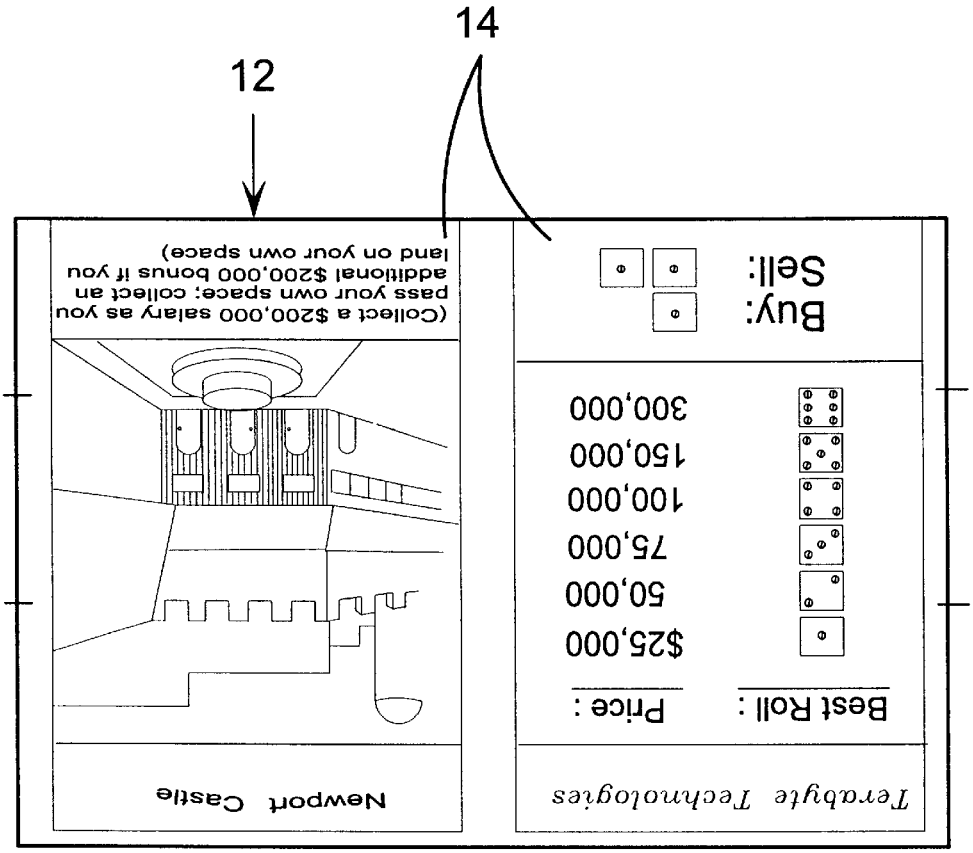
Figure 20:
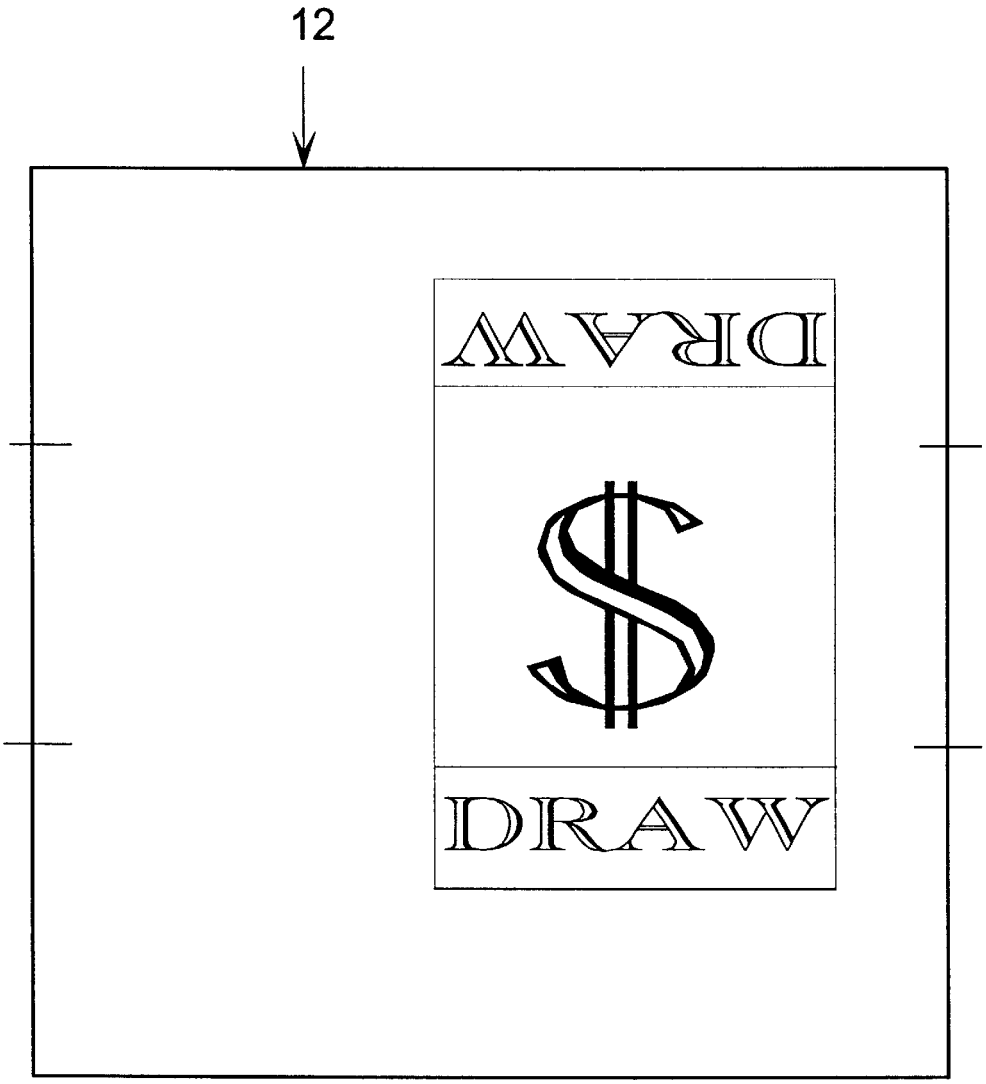
Figure 2P:
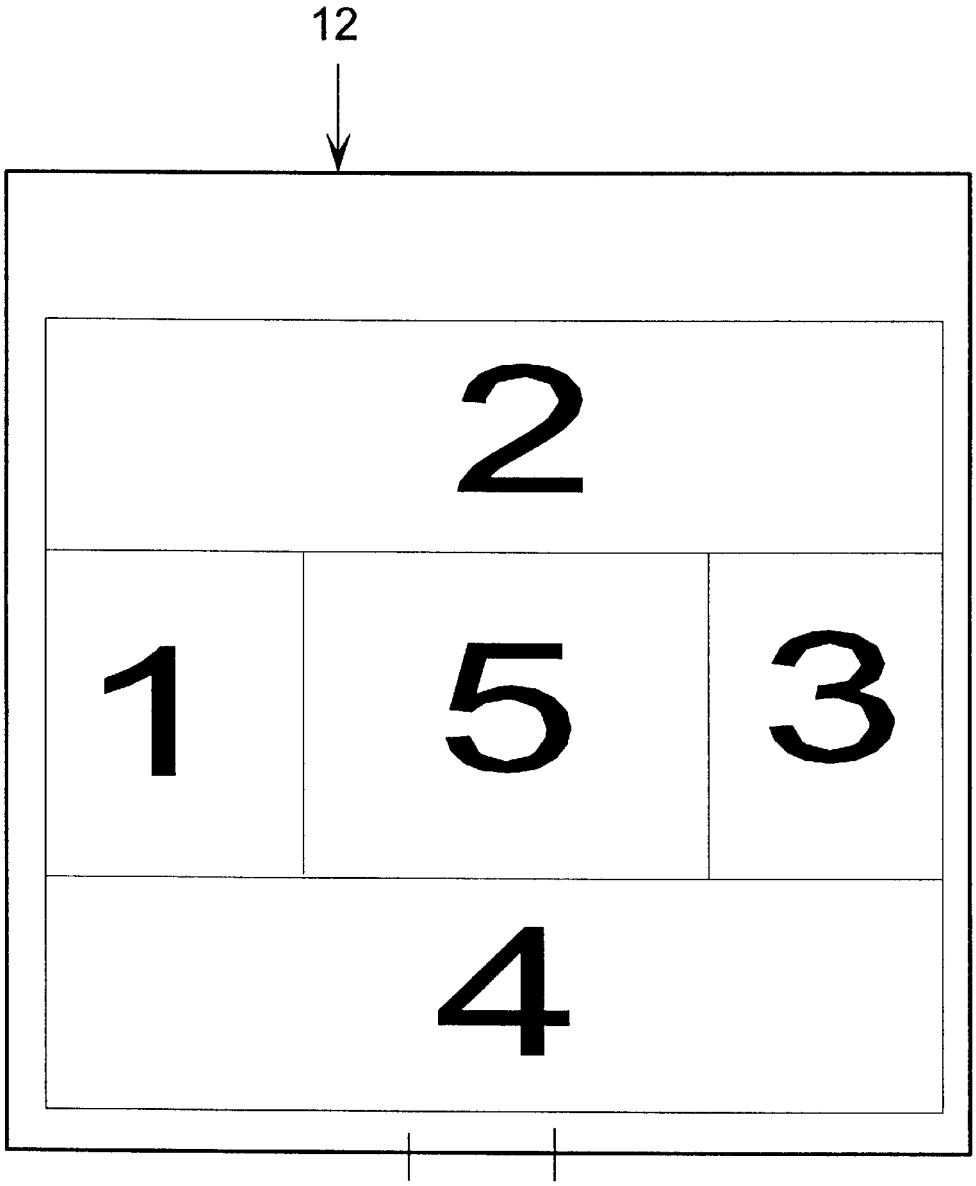
Figure 2Q:
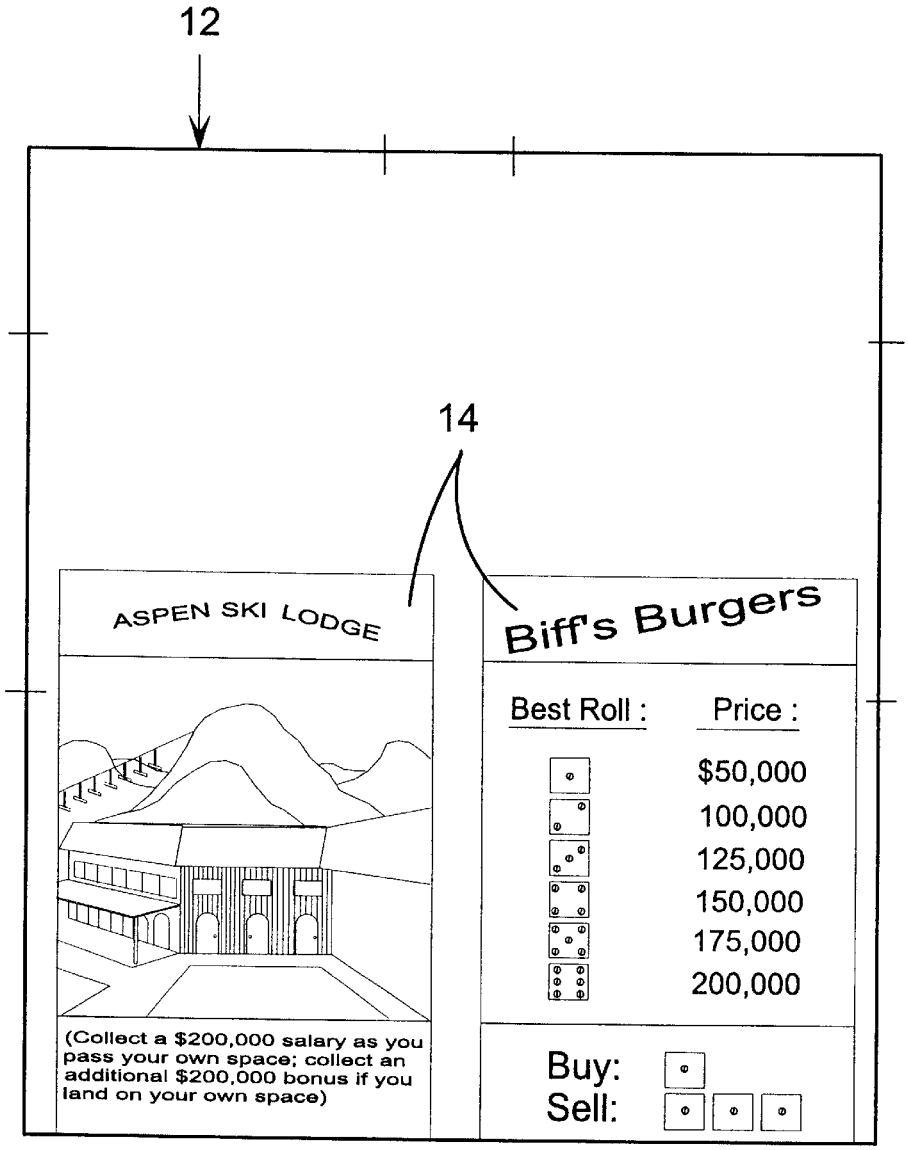
Figure 2R:
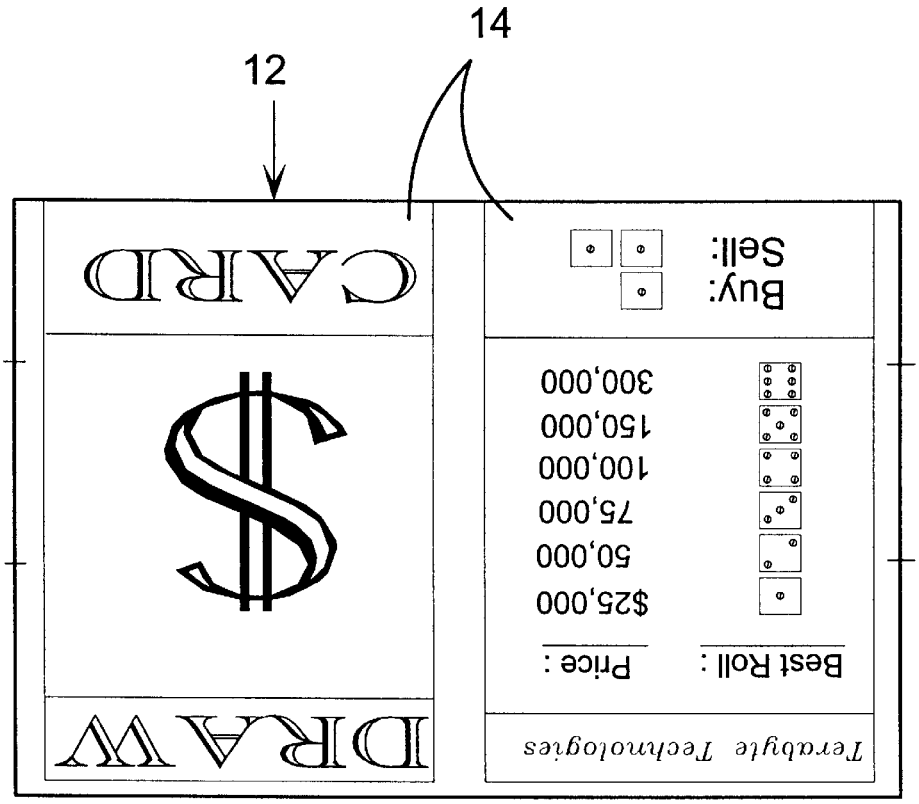
Figure 2S:
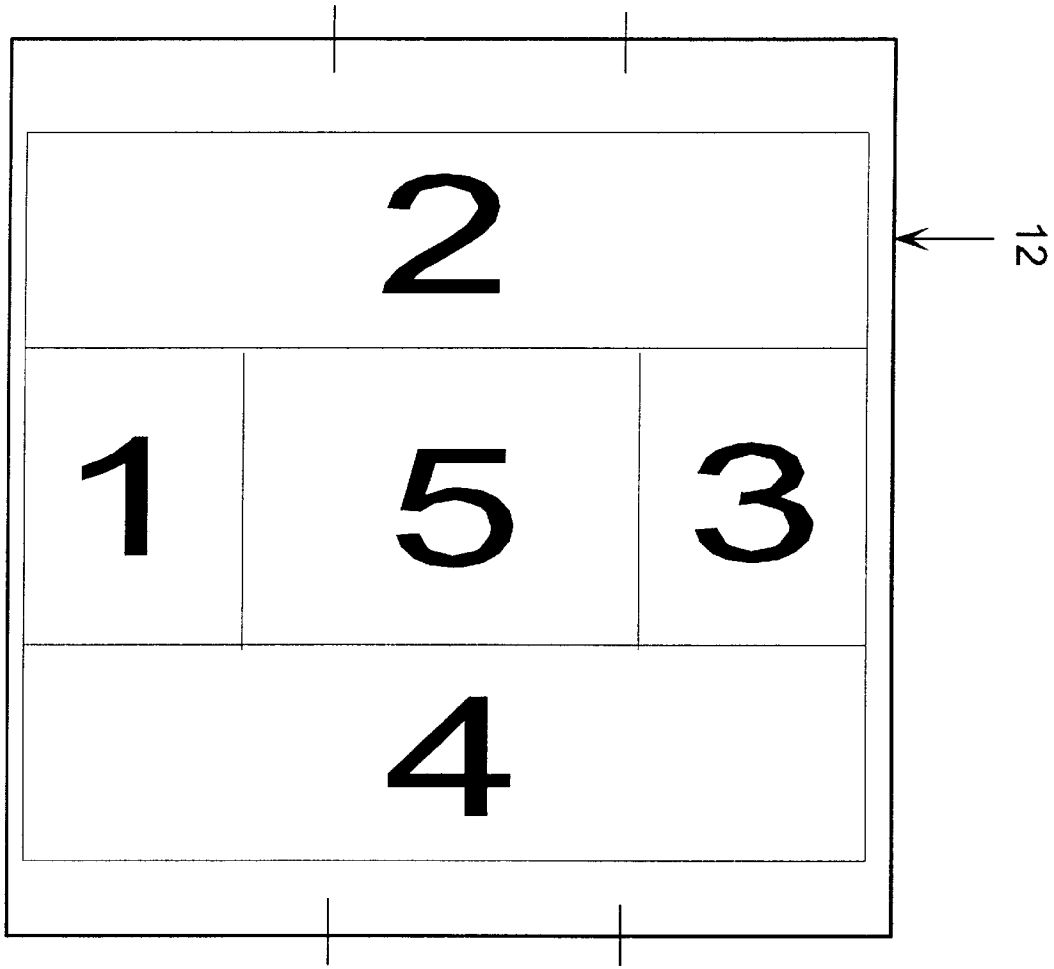
Figure 2T:
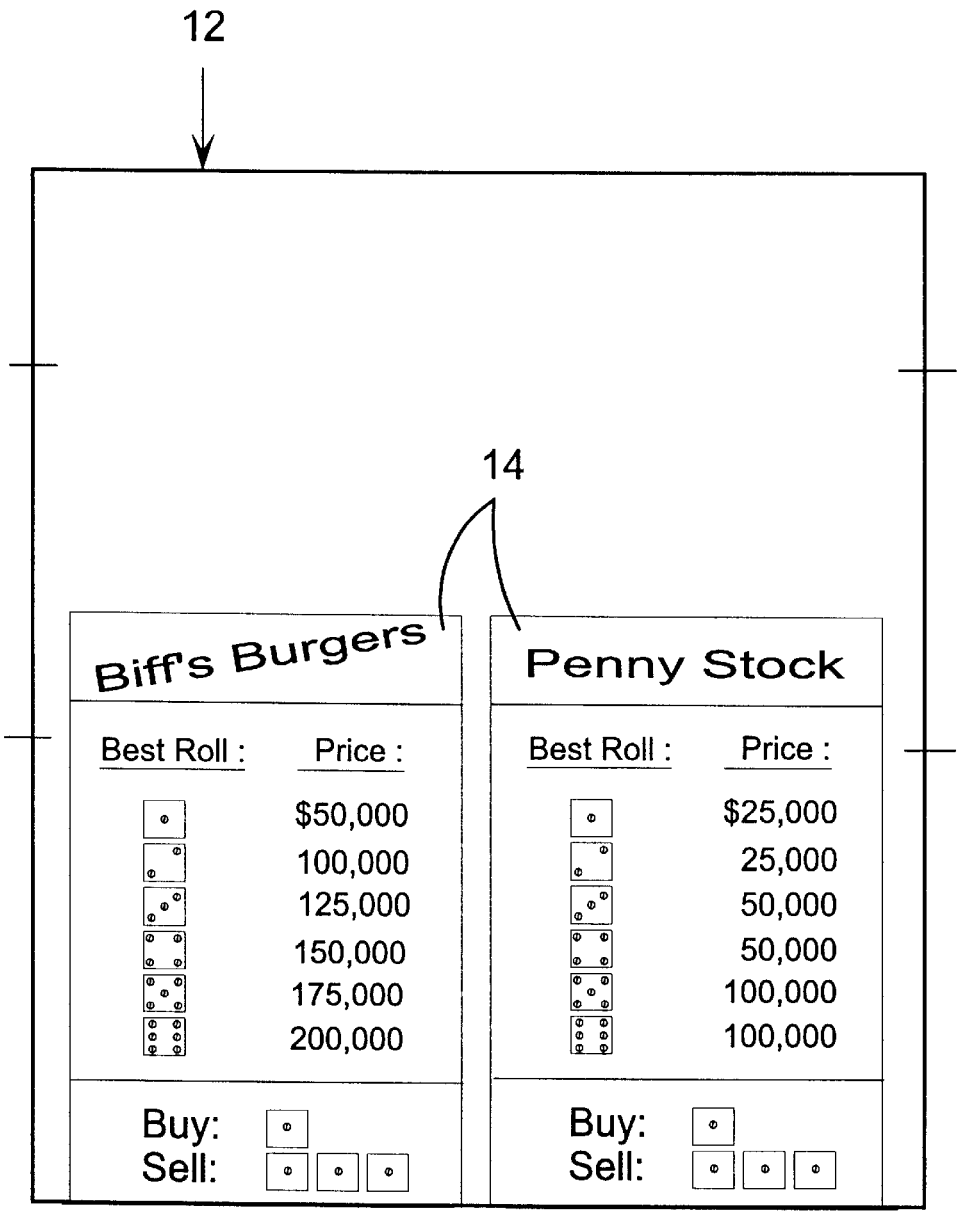
Figure 2U:
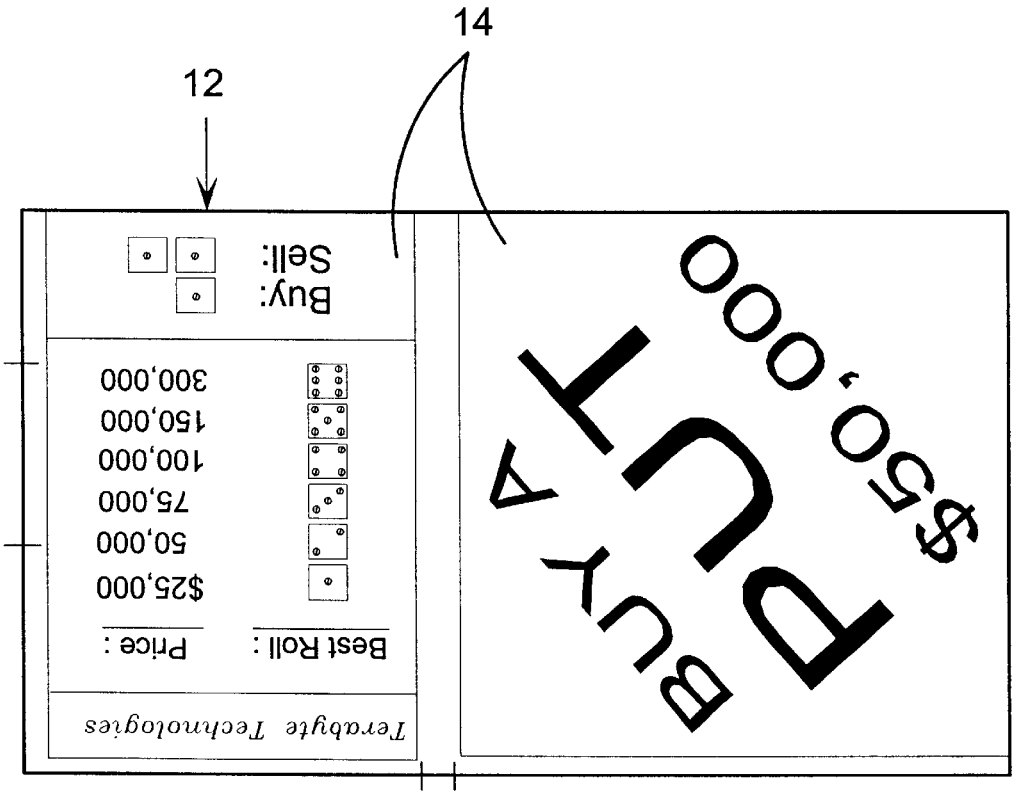
Figure 2V:
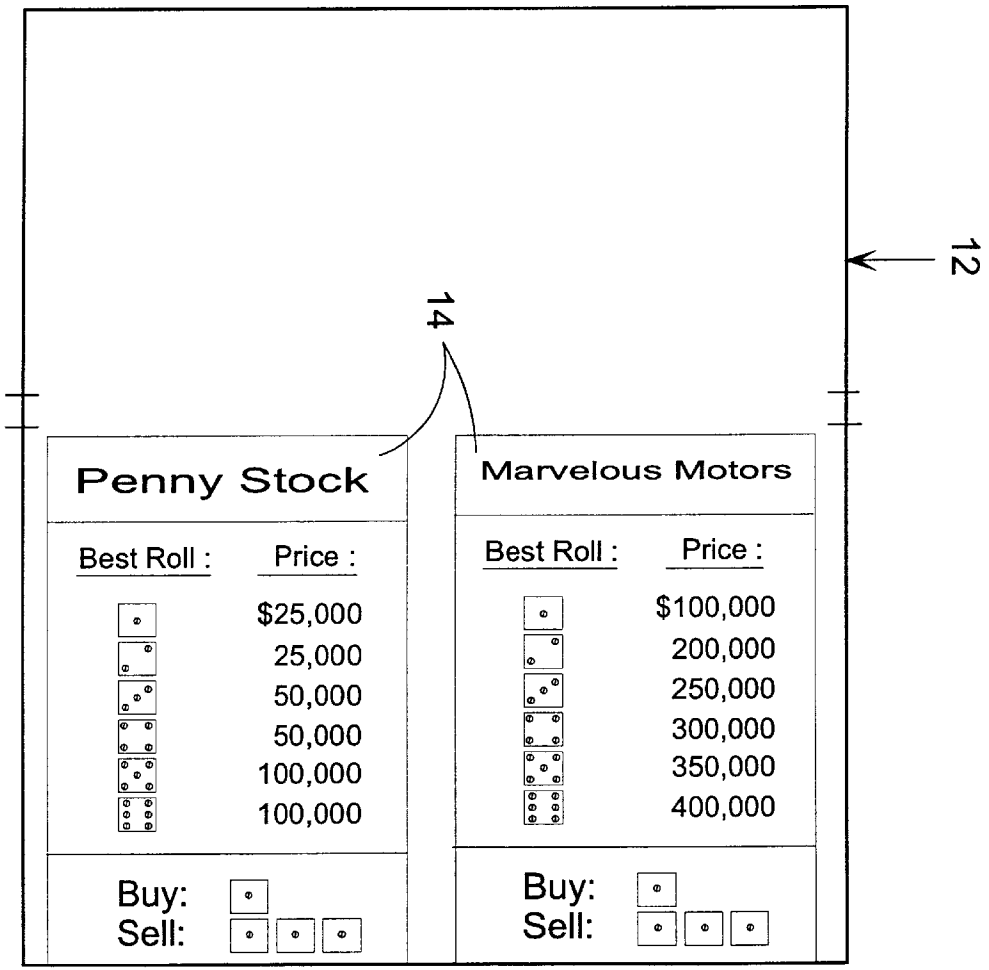
Figure 2W:
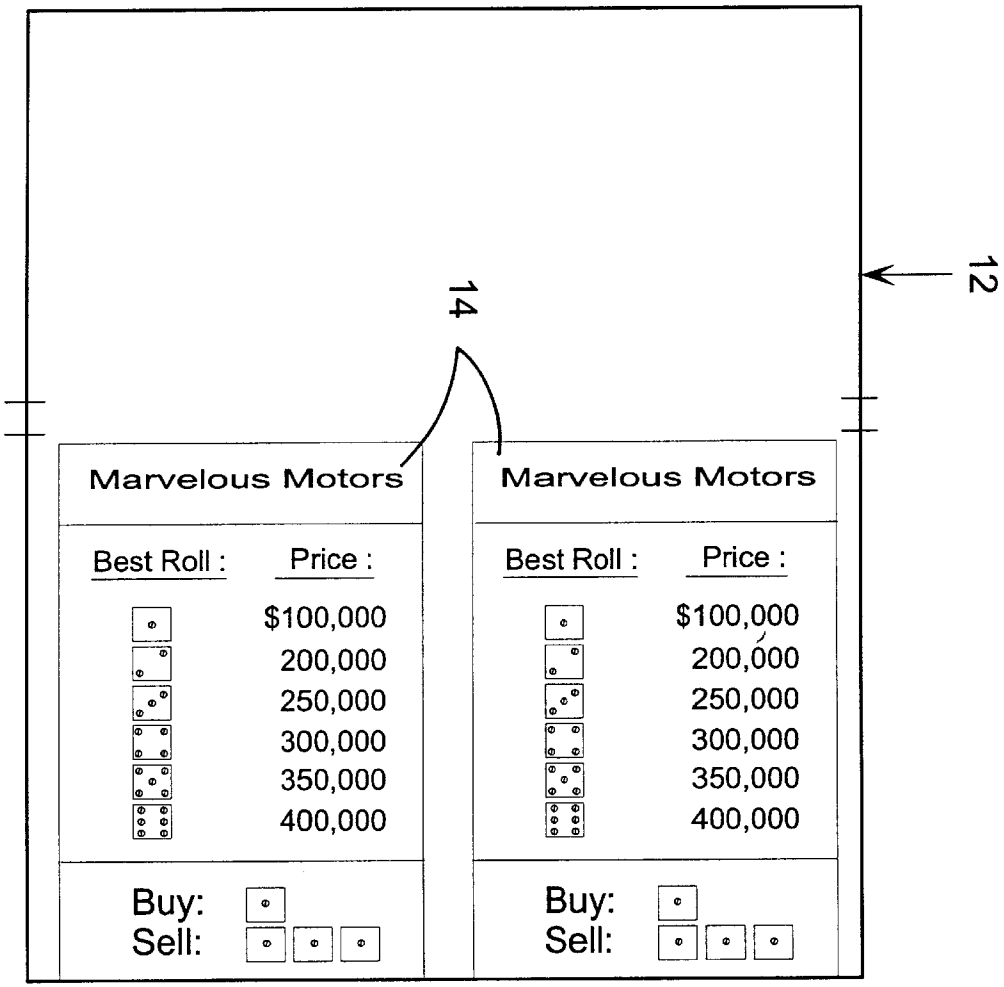
Figure 2X:
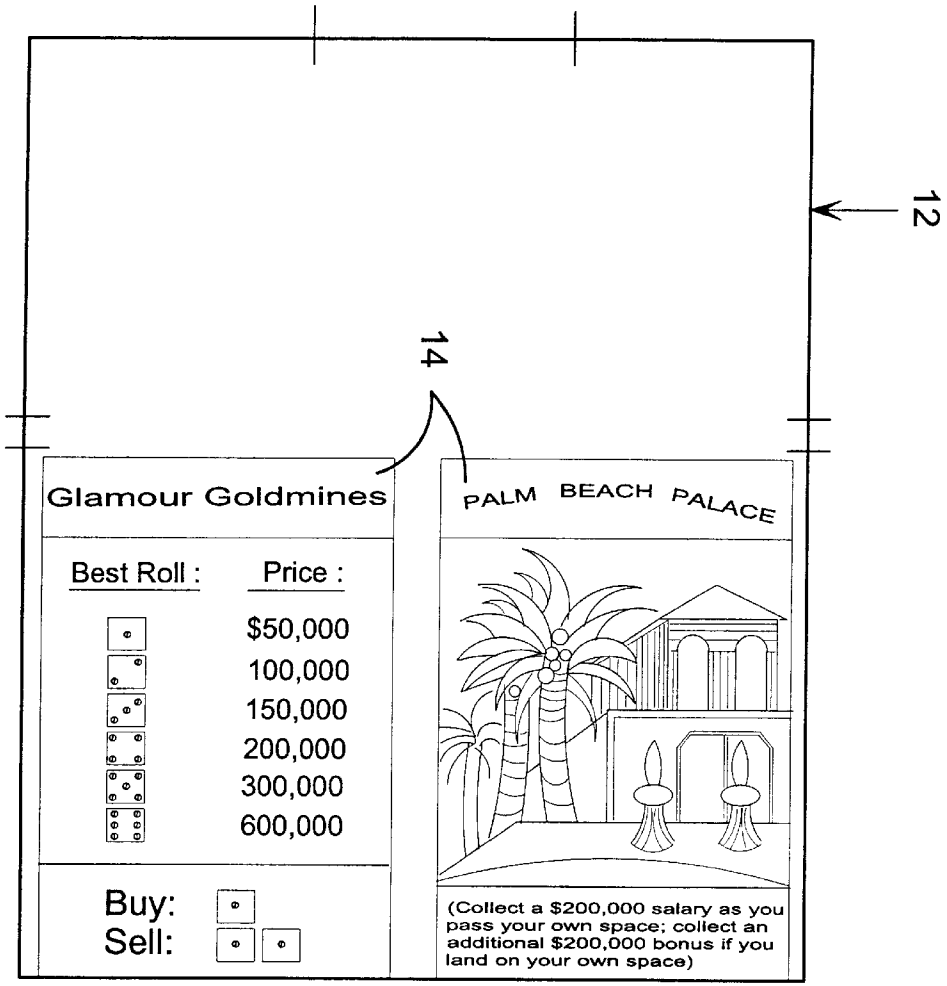
Figure 2Y:
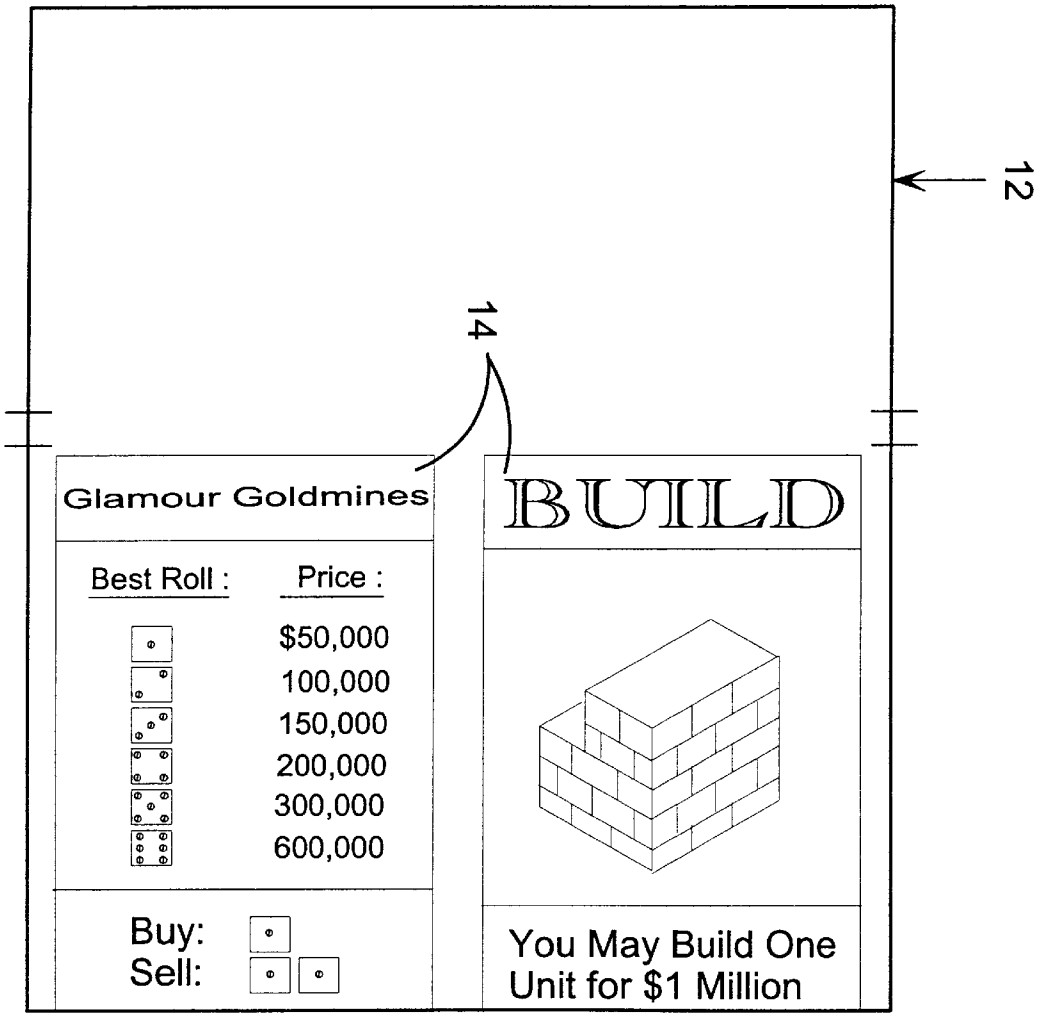
Figure 2Z:
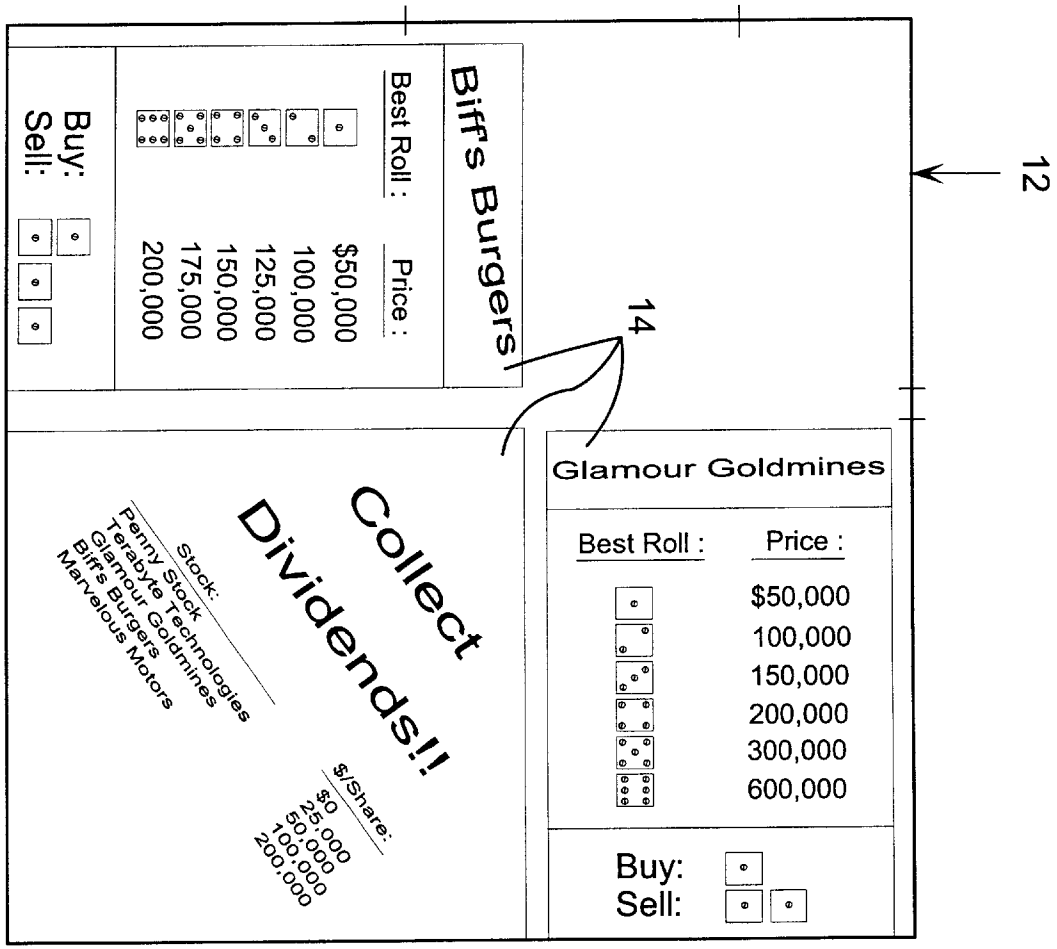

Turning to FIG. 2, shown therein is the board 12 with spaces 14 thereon shown in a block diagram depicting the location of each of the enlarged board sections which are numbered FIGS. 2A through 2Z and which are shown enlarged in FIGS. 2A through 2Z. The configuration of the particular board 12 shown is only one possible embodiment incorporating all of the components of the present invention 10. As previously stated, the exclusion of the bond component could require a change to the disclosed board layout. It is also possible to reorder or redesign some of the features disclosed without departing from the method of game play.

Figure 3:
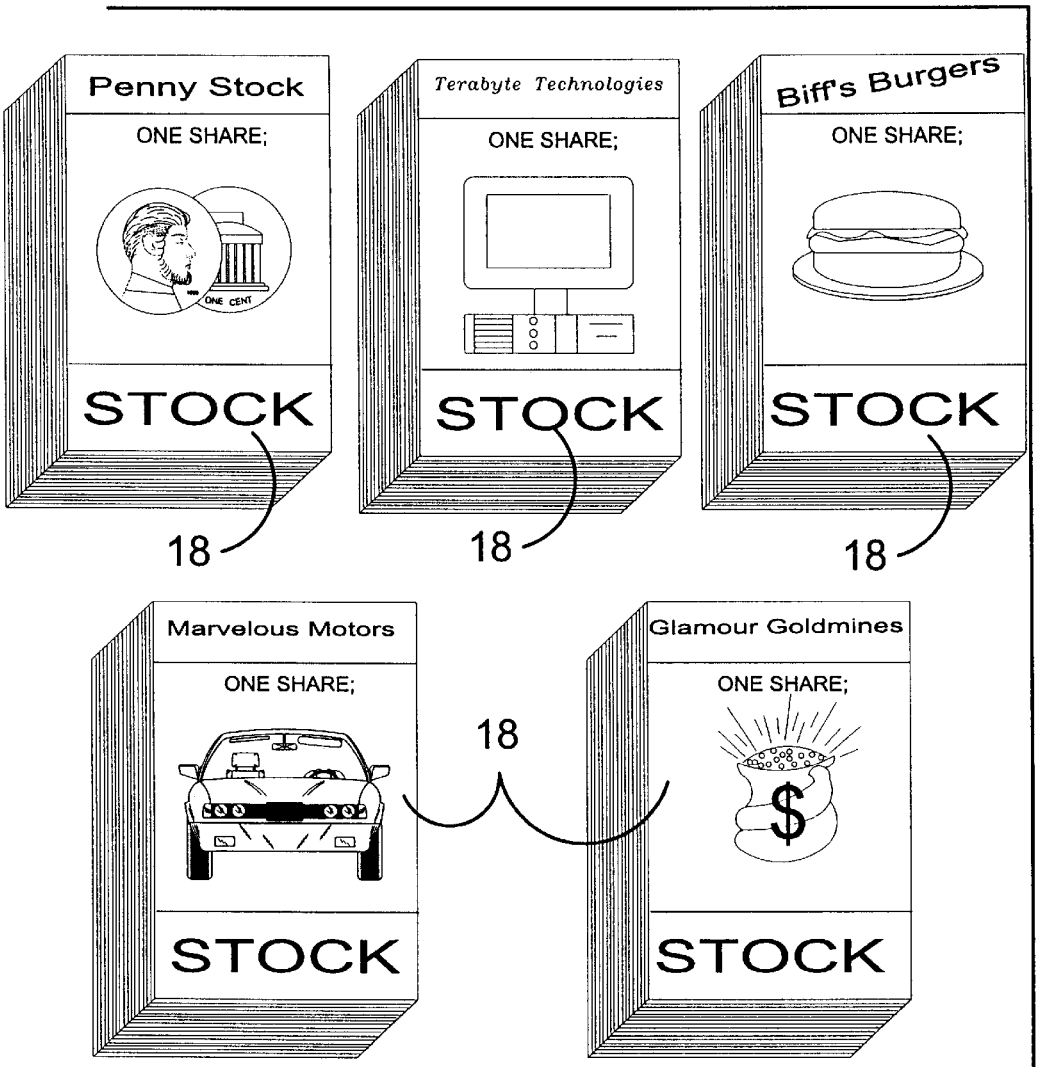
FIG. 3 is an illustrative view of one possible embodiment of the stock certificates component of the present invention.

Turning to FIG. 3, shown therein is an illustrative view of one possible embodiment of the stock certificates 18 component of the present invention. The board has a plurality of board spaces indicating the names of the company for the game related stock certificates and a plurality of mating card-like certificates 18 having the company name thereon that players take possession of representing ownership in a one share to one card relationship. The card-like stocks 18 can be selectively bought, sold or traded by their owner. Their value varies according to predetermined rules except between players who can determine their value at will.

Figure 4:
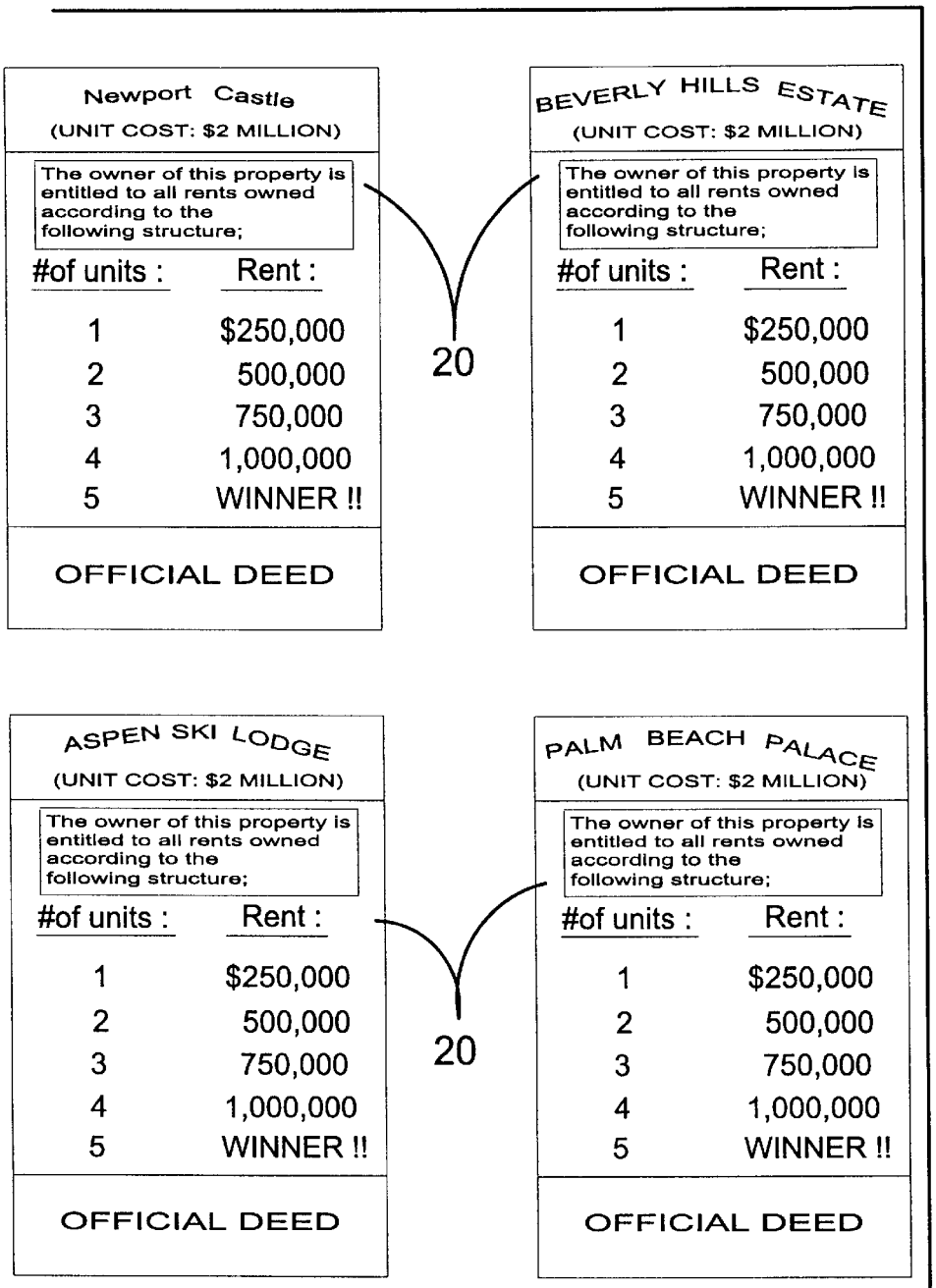
FIG. 4 is an illustrative view of one possible embodiment of the player property deeds of the present invention.

Turning to FIG. 4, shown therein is an illustrative view of one possible embodiment of the player property deed 20 cards of the present invention. The board has a plurality of board spaces indicating the names of game related properties and a plurality of mating card-like property deeds 20 that players selectively choose or are assigned at the start of a game. Ownership is maintained throughout the game with the object of the game to build a predetermined number of housing units on the named property until a predetermined maximum has been reached. The first player to achieve this is declared the winner. FIG. 4 shows an embodiment of the present invention wherein a winner would be declared when five housing units were constructed although numbers other than five could also be used.

Figure 5:
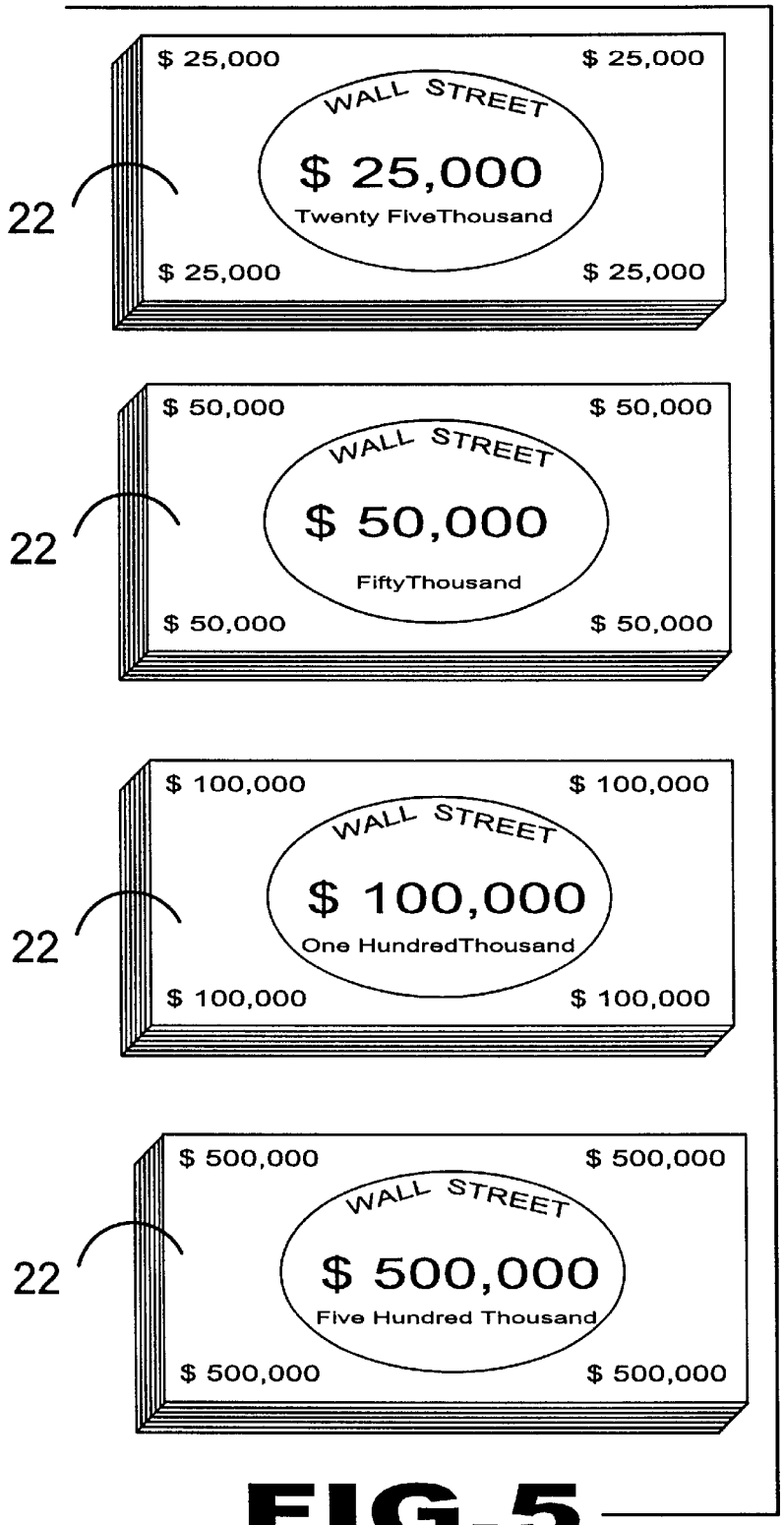
FIG. 5 is an illustrative view of one possible embodiment of the monetary bills of the present invention.
Figure 6:
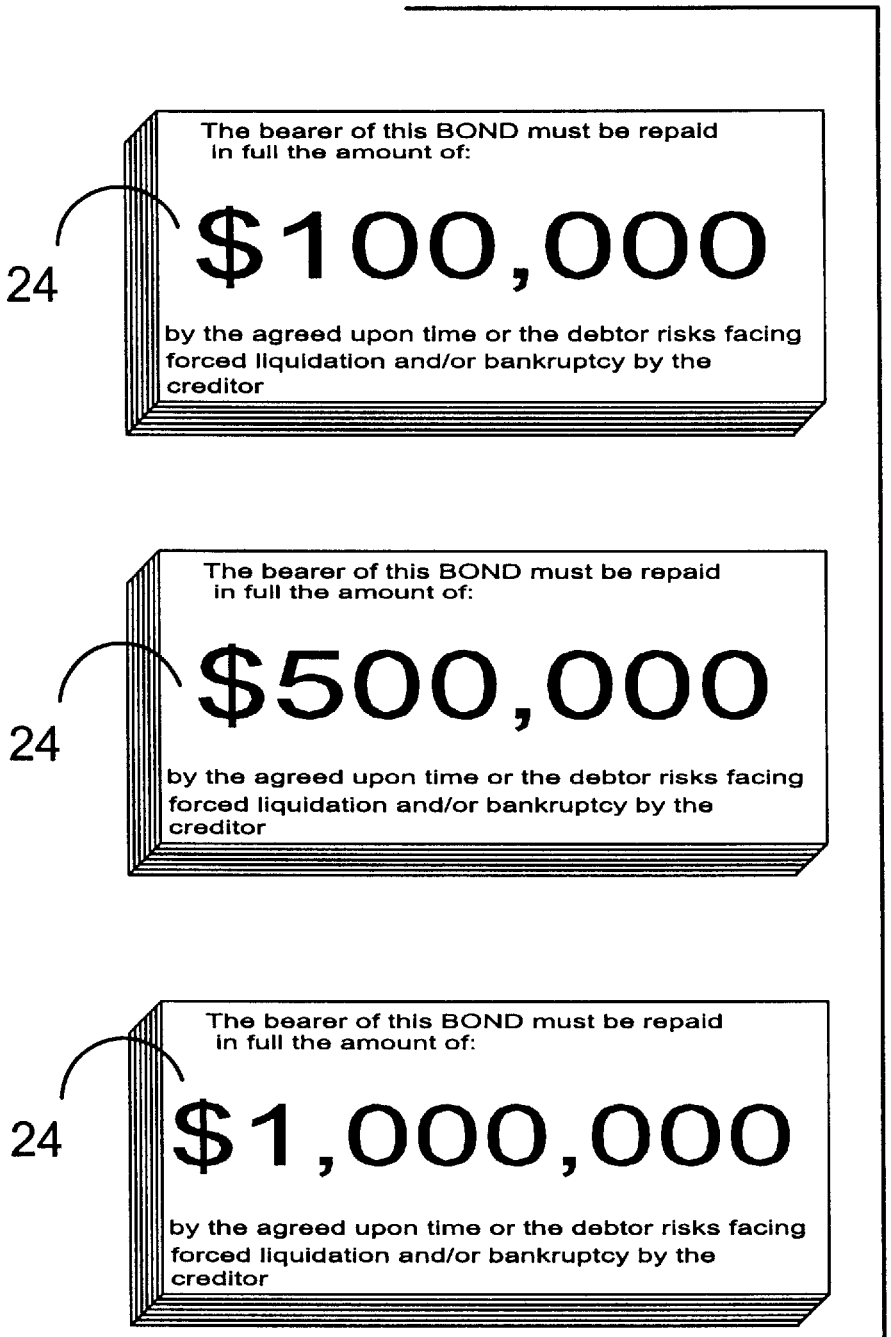
FIG. 6 is an illustrative view of one possible embodiment of the bond certificates component of the present invention.

Turning to FIG. 5, shown therein is an illustrative view of one possible embodiment of the various denominations of the monetary bills 22 component of the present invention. Each player is issued a predetermined amount of various denominations of money 22 at the start of the game and game play provides the opportunity to accumulate more money in an effort to purchase the housing units that are placed on the player's property until a predetermined maximum of housing units are accumulated which determines the game winner Turning to FIG. 6, shown therein is an illustrative view of one possible embodiment of the various denominations of the bond certificates 24 component of the present invention. Each player is issued a predetermined amount of various denominations of bond certificates 24 at the start of the game and during game play each player can redeem a percentage of the face value from the bank at any time during the game. The player is required to redeem the bond 24 back from the bank in a predetermined number of game play passes around the board, e.g., two turns around the board. Players may also redeem these bonds 24 from opposing players under negotiated terms.

Figure 7:
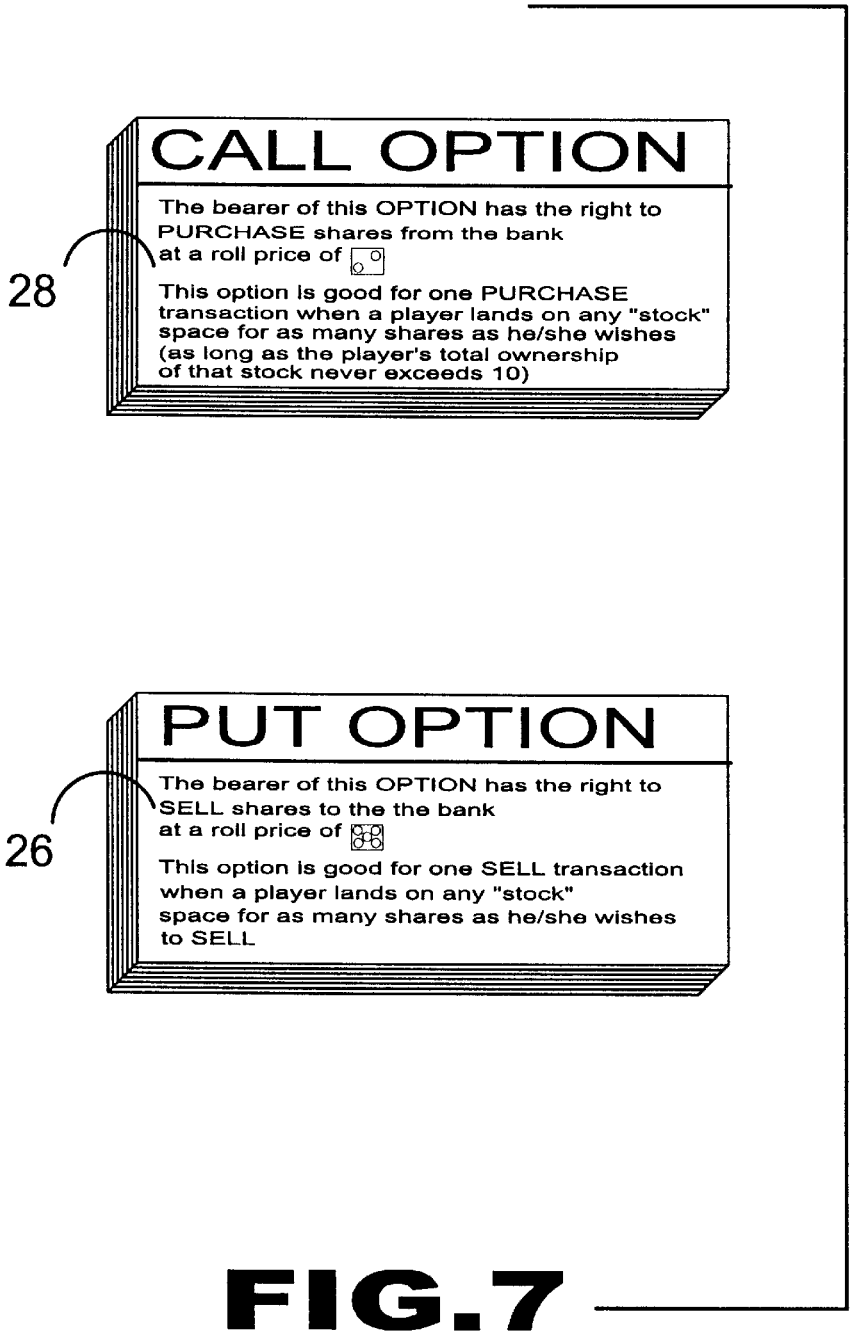
FIG. 7 is an illustrative view of one possible embodiment of the option cards of the present invention.

Turning to FIG. 7, shown therein is an illustrative view of one possible embodiment of the option cards 26, 28 of the present invention. The board has a plurality of board spaces indicating the name of put 26 or call 28 option whereby when a player lands on one of these board spaces they can purchase the named option for the board space specified amount to be used at the player's discretion.

Figure 8:
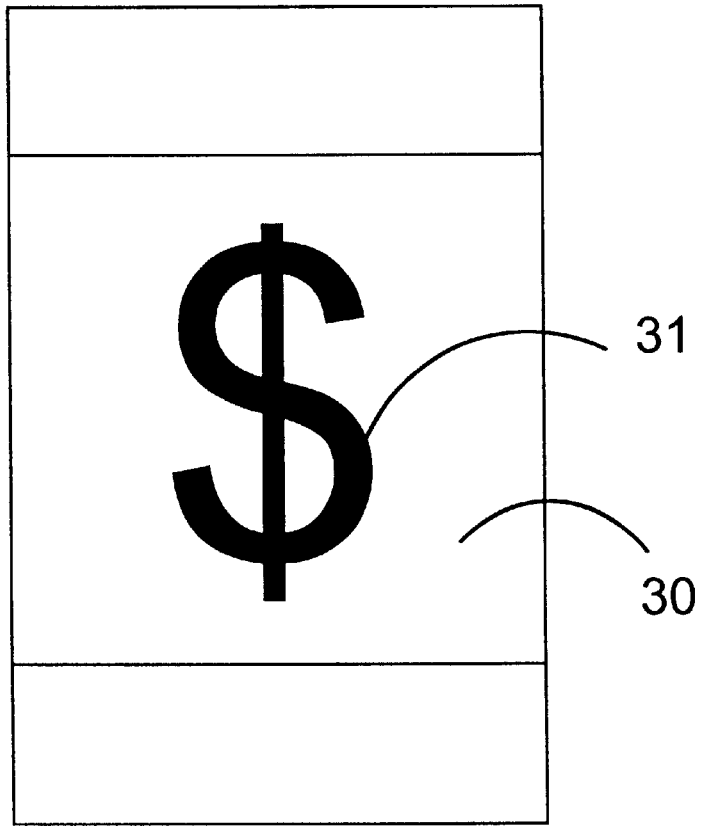
FIG. 8 is an illustrative view of one possible embodiment of the draw cards of the present invention.

Turning to FIG. 8, shown therein is an illustrative view of one possible embodiment of the draw cards 30 of the present invention. The board has a plurality of board spaces with indicia representing a plurality of game draw cards 30. Each card 30 has common indicia, e.g., a $ (dollar) sign 31, on one side and instructions to be carried out by a player on the other side.

Figure 9:
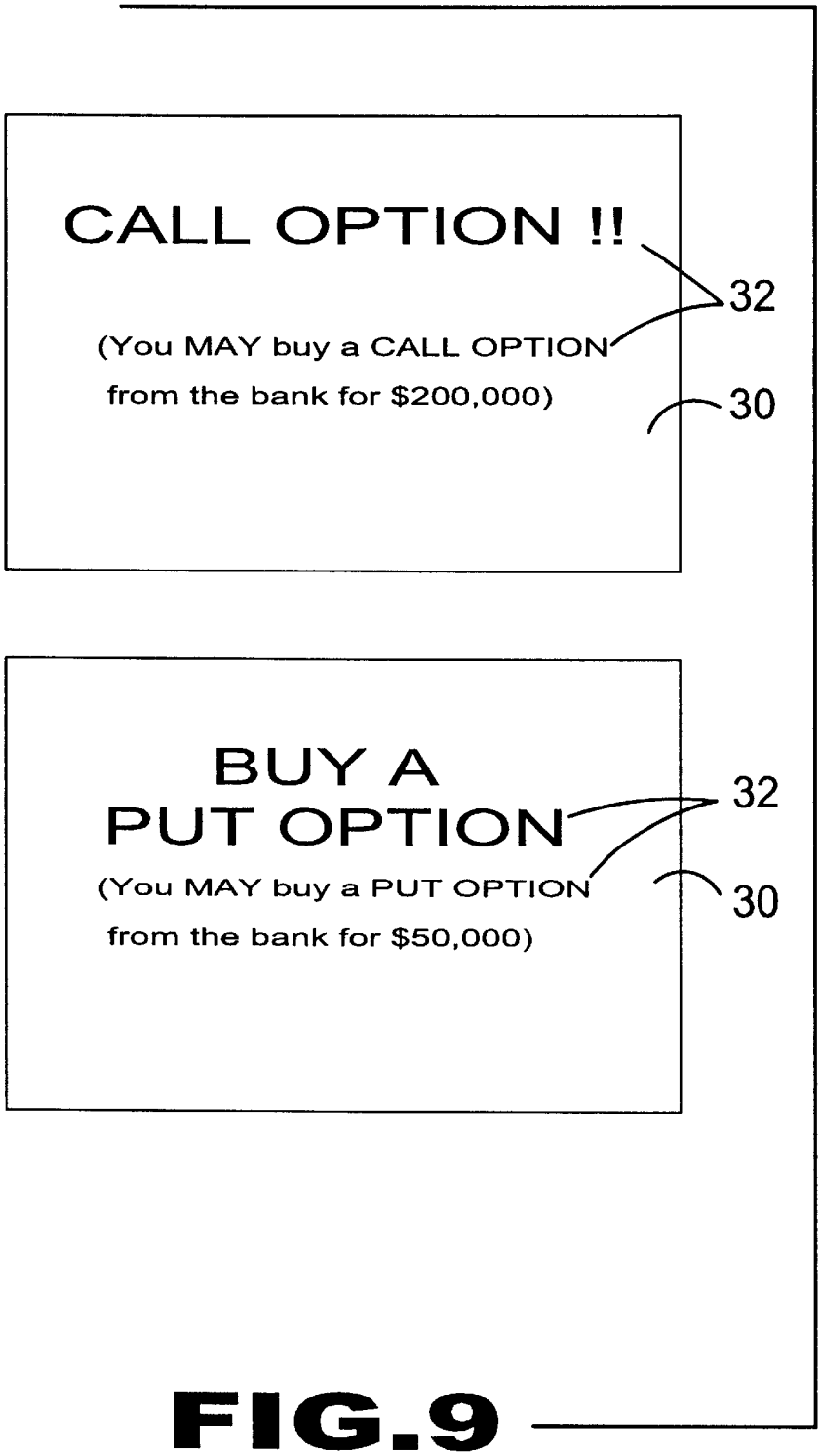
FIG. 9 is an illustrative view of possible player draw cards instructions of the present invention.

Turning to FIG. 9, shown therein is an illustrative view of possible player draw cards instructions 30 of the present invention. The board has a plurality of board spaces with indicia representing a plurality of game draw cards 30 as previously explained. Each card 30 has common indicia on one side, e.g., a $ sign, and instructions 32 to be carried out by a player on the other side of the card.

Turning to FIG. 10, shown therein is another illustrative view of possible player draw cards instructions 32 of the present invention. The board has a plurality of board spaces with indicia representing a plurality of game draw cards 30. Each card 30 has common indicia on one side and instructions 32 to be carried out by a player on the other side of the card.

Figure 11:
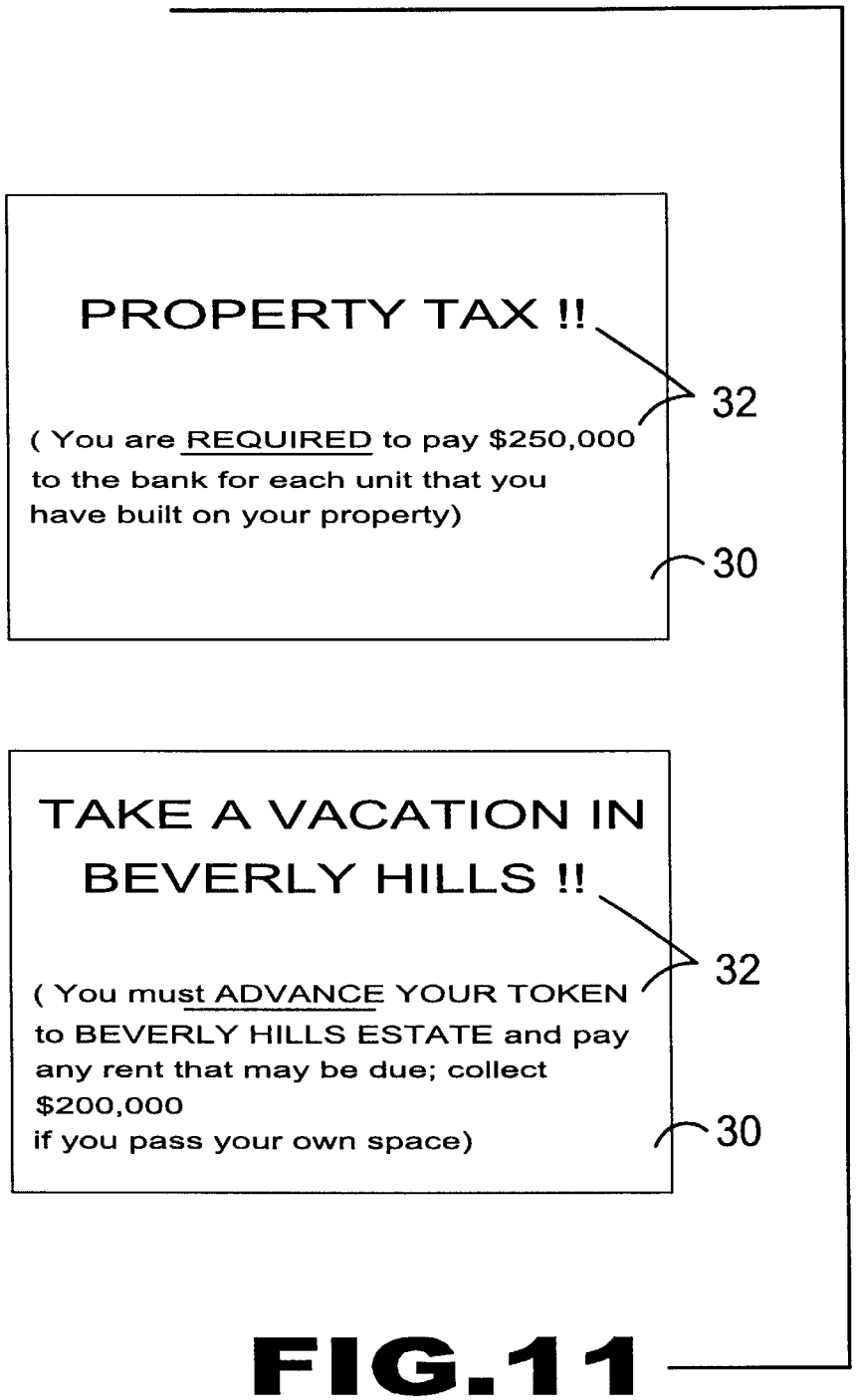
FIG. 11 is another illustrative view of possible player draw cards instructions of the present invention.

Turning to FIG. 11, shown therein is another illustrative view of possible player draw cards instructions 32 of the present invention. The board has a plurality of board spaces with indicia representing a plurality of game draw cards 30. Each card 30 has common indicia on one side and instructions 32 to be carried out by a player on the other side of the card.

Figure 12:
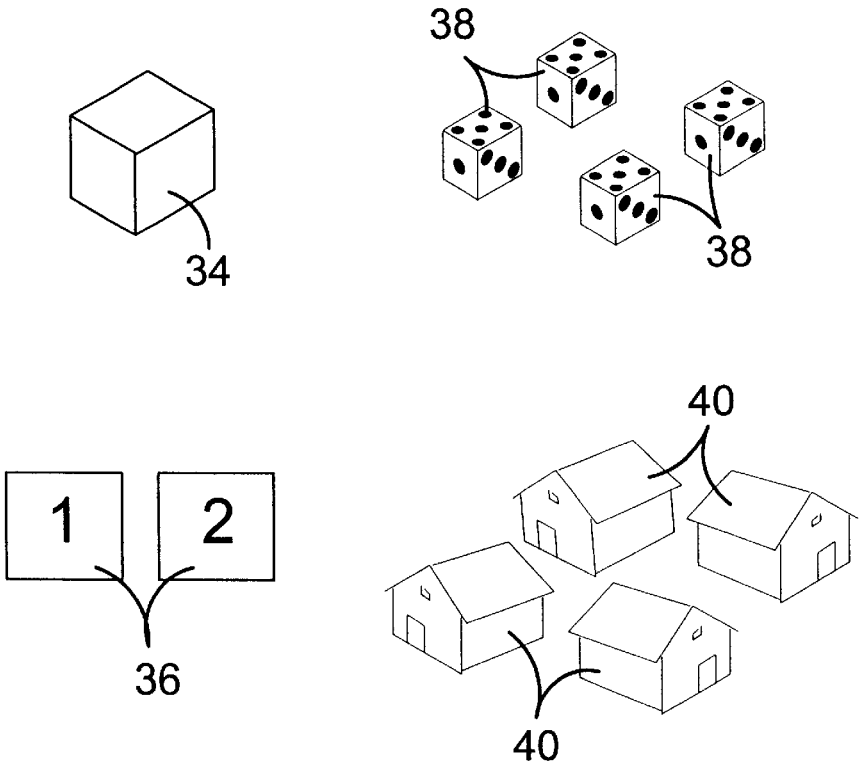
FIG. 12 is an illustrative view of one possible embodiment for additional game pieces of the present invention.

Turning to FIG. 12, shown therein is an illustrative view of one possible embodiment for additional game pieces of the present invention. Shown is one possible embodiment for the player pieces 34 of the present invention. Also shown is one possible embodiment for the bond repayment markers 36 and housing units 40 of the present invention. Also shown are a plurality of dice 38 used during game play.

I claim:

1. A financial game for a plurality of players, comprising:

a) a game board, said game board having a plurality of adjacent spaces arranged about its perimeter wherein each space is provided with indicia imprinted thereon whereby a plurality of players compete for the common goal of obtaining a predetermined number of housing units to be placed on a preselected property;

b) wherein said spaces comprise a plurality of property deed spaces, in which a property deed space is initially assigned to a player and upon which property deed space a player builds a predetermined number of housing units, wherein said spaces further comprise a plurality of stock certificate spaces which stock certificate spaces indicate the highest and lowest price per share a stock will cost as determined by the player rolling a dice or die and paying a per share price equivalent to the total number of dimples displayed on the dice or die and the per unit cost displayed for the number of dimples inscribed on a stock certificate board space, wherein said spaces further comprise a plurality of option spaces which allow a player the opportunity to purchase a put or call option, wherein said spaces further comprise a plurality of collect dividend spaces that allow a player to collect dividends from the bank, wherein said spaces further comprise a plurality of discounted housing unit spaces which allow a player to build a housing unit at a discounted price, wherein said spaces further comprise a plurality of draw card spaces, which draw card spaces represent a plurality of draw cards which can award or penalize the ownership of stock, housing units or provide other benefits or detriments to a player's assets;

c) a plurality of playing pieces, said playing pieces matching sad plurality of property deed spaces assigned to a player;

d) a plurality of housing units for placement on or near said property deed spaces assigned to a player;

e) at least one dice, wherein said dice is rolled by a player and a player advances the number of said spares equal to the total number of dimples displayed on the upper surface of the dice;

f) a set of property deed cards wherein said property deed cards indicates the price per unit and the rent per number of housing units placed on said property deed space;

g) a set of stock certificate cards wherein said cards indicate the name of the stock;

h) a set of monetary bills for distribution to a player, said monetary bills having a plurality of monetary denominations;

i) a set of option cards which option cards indicate whether the option is a call option or a put option and the number of dimples of said dice used to determine the unit cost of each stock share; and, j) a set of draw cards wherein said draw cards have a common indicia printed on one side and a set of instructions to be followed by a player printed on a second side, said instructions allow a player to buy a call option allowing a player to buy a put option, allowing a player to collect dividends on stock owned by the player, designated the price for which a penny stock can be sold, designating that a player pay a designated amount of property tax, and designating that a player should advance to a designated property deed space and pay a designated amount of rent for being on the designated property deed space;

(k) a set of bond certificates, said bond certificates being issued in a plurality of denominations wherein each player is issued a predetermined number of bond certificates at the start of the game and during each play a player can obtain a percentage of the face value of said bond certificate from the bank at any time during the game, wherein said bond certificates must be redeemed back from the bank in a predetermined number of turns around the board; and (l) a plurality of bond repayment markers, each of said bond repayment markers to be placed on said board at the position at which a player obtains said bond certificate.

* * * * *